US012808620B2

(12) United States Patent
Moore

(10) Patent No.: US 12,808,620 B2
(45) **Date of Patent: *Nov. 24, 2026**

(54) FIREARM LOCK MECHANISM

(71) Applicant: Elucidamus LLC, Lenexa, KS (US)

(72) Inventor: Warren V. Moore, Lenexa, KS (US)

(73) Assignee: Elucidamus LLC, Lenexa, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/042,496

(22) Filed: Jan. 31, 2025

(65) Prior Publication Data

US 2025/0198719 A1 Jun. 19, 2025

Related U.S. Application Data

(60) Continuation of application No. 18/366,301, filed on Aug. 7, 2023, now Pat. No. 12,215,941, which is a division of application No. 17/523,666, filed on Nov. 10, 2021, now Pat. No. 11,754,359.

(60) Provisional application No. 63/131,969, filed on Dec. 30, 2020.

(51) Int. Cl.
*F41A 17/76* (2006.01)
*F41C 3/14* (2006.01)

(52) U.S. Cl.
CPC ..... *F41A 17/76* (2013.01); *F41C 3/14* (2013.01)

(58) Field of Classification Search
CPC ..... F41A 17/76; F41A 17/82; F41A 19/53
USPC ..... 42/70.08
See application file for complete search history.

(56) References Cited

U.S. PATENT DOCUMENTS

| | | | | |
|---|---|---|---|---|
| 3,337,979 | A * | 8/1967 | Freed | F41A 19/53 42/69.01 |
| 3,503,149 | A * | 3/1970 | Hedges | F41A 17/74 42/65 |
| 8,096,079 | B2 * | 1/2012 | Zajk | F41A 19/51 49/65 |
| 12,215,941 | B2 * | 2/2025 | Moore | F41A 19/53 |
| 2005/0183313 | A1 * | 8/2005 | Baker | F41A 17/82 42/70.08 |
| 2021/0033364 | A1 * | 2/2021 | Mather | F41A 17/76 |

* cited by examiner

*Primary Examiner* — Bret Hayes
(74) *Attorney, Agent, or Firm* — Hovey Williams LLP

(57) ABSTRACT

A firearm lock mechanism includes a trigger, a hammer, a stirrup connected to the hammer at a stirrup connection point, and a spring operably connected to the stirrup at a spring connection point. Progressive pivoting of the trigger drives corresponding progressive pivoting of the hammer. The stirrup connection point is disposed forward of the hammer pivot point. One of the spring connection point, hammer pivot point, and stirrup connection point is offset relative to and laterally spaced between the others of the points to be a vertex of an intermediate angle cooperatively defined by the points. The angle increases in magnitude as the trigger drives pivoting of the hammer. A toggle line is defined between the trigger pivot point and the hammer pivot point. The trigger contacts the hammer at a contact point that shifts across the toggle line as the trigger drives pivoting of the hammer.

20 Claims, 17 Drawing Sheets

FIREARM LOCK MECHANISM

CROSS REFERENCE TO RELATED APPLICATIONS

The present application is a continuation of U.S. patent application Ser. No. 18/366,301, filed Aug. 7, 2023, which is a division of U.S. patent application Ser. No. 17/523,666, filed Nov. 10, 2021, which claims priority from U.S. Provisional Application No. 63/131,969, filed Dec. 30, 2020, entitled IMPROVED FIREARM LOCK MECHANISM, each of which is hereby incorporated in its entirety by reference herein.

BACKGROUND OF THE INVENTION

1. Field of the Invention

The present invention relates generally to a lock mechanism for a firearm.

2. Discussion of the Prior Art

Conventional firearms typically include a lock mechanism (or lockworks) including a trigger, a hammer, a mainspring, a stirrup connecting the mainspring to the hammer, a sear operably connected to the hammer, and a rebound slide. From an initial resting state, actuation or movement of the trigger results in corresponding actuation or movement of the hammer.

After sufficient actuation of the hammer (e.g., to a state commonly referred to as "cocked"), either as a result of trigger actuation in a "double-action" process or via manual cocking by a user in a "single-action" process, further actuation of the trigger causes release of the hammer. Release of the hammer results in a rapid fall thereof and, in turn, impact on a primer and subsequent firing of the firearm.

Actuation of the trigger at various stages conventionally requires application of a corresponding minimum sufficient force (commonly referred to as a "pull force," "trigger pull," "pull weight," etc.) to overcome resistive forces to trigger motion associated with the remaining components of the lock mechanism. These resistive forces conventionally vary depending on the position of the trigger within its range of motion and on whether a single-action or double-action process is being used. For instance, in a conventional firearm undergoing a single-action process (i.e., in a single-action mode), pre-cocking of the hammer results in comparatively low resistive forces against trigger actuation through hammer fall (because the trigger does not have to effect cocking of the hammer and instead must act only to release the hammer). In a conventional firearm undergoing a double-action process (i.e., in a double-action mode), however, cocking of the hammer via trigger actuation, prior to release thereof, results in comparatively high resistive forces.

It is particularly noted that "pull force," "trigger pull," "pull weight," etc. as referred to herein do not necessarily pertain to the actual forces applied by a user to a trigger but instead to the lowest magnitude forces that must be applied to the trigger to result in actuation thereof. That is, the pull force is defined by the trigger and associated mechanisms, and not by a user. (Whereas a user might apply gradually increasing forces to the trigger until the applied force equals or just exceeds the pull force, a user might instead rapidly apply excessive forces that are substantially greater than the pull force.)

A variety of firearm designs and modifications have been presented in an attempt to compensate for or reduce the conventional large double-action trigger pull forces described above. Among other things, for instance, hammers have been skeletonized to reduce weight, contact surfaces have been polished, and mainspring forces have been reduced or altered. However, such prior art modifications have failed to significantly reduce double-action trigger pull forces, both in a nominal sense and in comparison to single-action trigger pull forces.

SUMMARY

According to one aspect of the present invention, a lock mechanism for a firearm is provided. The firearm is configured to launch a projectile in a lateral direction. The lock mechanism includes a trigger pivotable about a trigger pivot point, a hammer pivotable about a hammer pivot point, a stirrup connected to the hammer at a stirrup connection point, and a spring operably connected to the stirrup at a spring connection point. Progressive pivoting of the trigger about the trigger pivot point, from a preparatory trigger position to an imminent release trigger position, drives corresponding progressive pivoting of the hammer about the hammer pivot point, from a preparatory hammer position to an imminent release hammer position. The spring selectively resists pivoting of the hammer from the preparatory hammer position to the imminent release hammer position. One of the spring connection point, the hammer pivot point, and the stirrup connection point is offset relative to and laterally spaced between the others of the points so as to be a vertex of an intermediate angle cooperatively defined by the points. The intermediate angle increases in magnitude as the hammer pivots from the preparatory hammer position to the imminent release hammer position.

According to another aspect of the present invention, a lock mechanism for a firearm is provided. The lock mechanism includes a trigger pivotable about a trigger pivot point. The lock mechanism further includes a hammer pivotable about a hammer pivot point, with a toggle line being defined between the trigger pivot point and the hammer pivot point. The trigger progressively pivots about the trigger pivot point, from a preparatory trigger position to an imminent release trigger position, to drive the hammer about the hammer pivot point, from a preparatory hammer position to an imminent release hammer position. The trigger contacts the hammer at a contact point disposed on a first side of the toggle line when the trigger is in the preparatory trigger position and the hammer is in the preparatory hammer position. The contact point is shifted to be disposed on a second side of the toggle line, opposite the first side, when the trigger is in the imminent release trigger position and the hammer is in the imminent release hammer position.

According to yet another aspect of the present invention, a lock mechanism for a firearm is provided. The lock mechanism includes a hammer pivotable about a hammer pivot point and configured to selectively engage a primer for launching a projectile in a forward direction. The lock mechanism further includes a stirrup connected to the hammer at a stirrup connection point and a spring operably connected to the stirrup at a spring connection point such that the spring yieldably resists pivoting of the hammer. The stirrup connection point is disposed forward of the hammer pivot point.

Among other things, the inventive features described above facilitate firing of the firearm in a double-action mode upon application to the trigger of a gradually and significantly decreasing trigger pull force. The inventive features described above also facilitate firing of the firearm in a double-action mode upon application to the trigger of trigger pull forces that, in a general sense, are of a relatively low magnitude compared to those required for similar firing of otherwise generally comparable prior art firearms.

This summary is provided to introduce a selection of concepts in a simplified form. These concepts are further described below in the detailed description of the preferred embodiments. This summary is not intended to identify key features or essential features of the claimed subject matter, nor is it intended to be used to limit the scope of the claimed subject matter.

Various other aspects and advantages of the present invention will be apparent from the following detailed description of the preferred embodiments and the accompanying drawing figures.

BRIEF DESCRIPTION OF THE DRAWING FIGURES

Preferred embodiments of the present invention are described in detail below with reference to the attached drawing figures, wherein.

Figure 1:
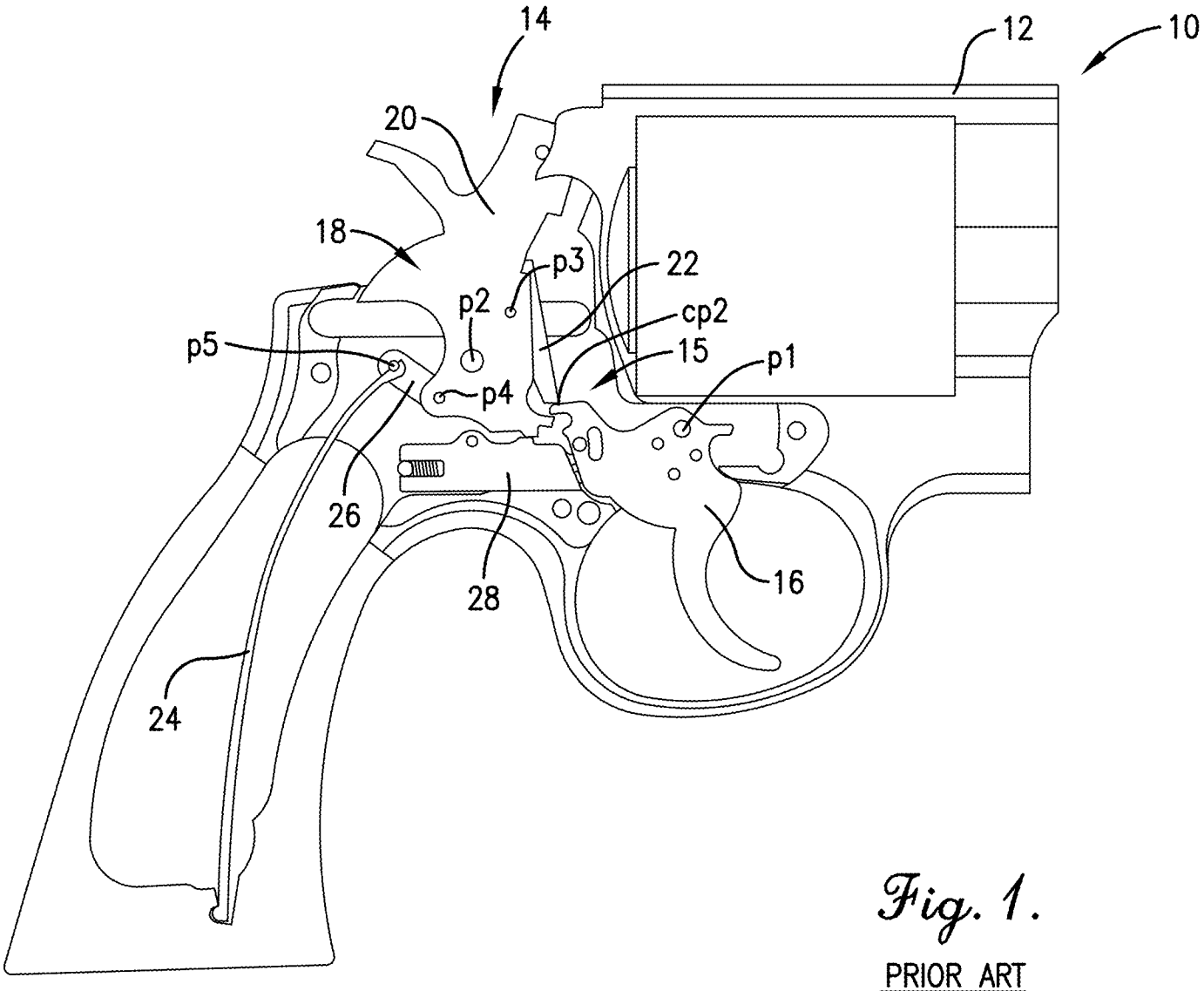
Fig. 1. PRIOR ART
FIG. 1 is a partially sectioned side view of a portion of a prior art firearm, particularly illustrating the lock mechanism in an initial contact state.

The drawing figures do not limit the present invention to the specific embodiments disclosed and described herein. While the drawings do not necessarily provide exact dimensions or tolerances for the illustrated structures or components, the drawings are to scale with respect to the relationships between the components of the structures illustrated in the drawings.

DETAILED DESCRIPTION

The present invention is susceptible of embodiment in many different forms. While the drawings illustrate, and the specification describes, certain preferred embodiments of the invention, it is to be understood that such disclosure is by way of example only. There is no intent to limit the principles of the present invention to the particular disclosed embodiments.

Furthermore, unless specified or made clear, the directional references made herein with regard to the present invention and/or associated components (e.g., top, bottom, upper, lower, inner, outer, etc.) are used solely for the sake of convenience and should be understood only in relation to each other. For instance, a component might in practice be oriented such that faces referred to as "top" and "bottom" are sideways, angled, inverted, etc. relative to the chosen frame of reference.

Overview: Sample Prior Art Firearm

A prior art firearm 10 is illustrated in FIGS. 1, 1A, 2, and 2A. The prior art firearm 10 includes, among other things, a frame 12 and a lock mechanism 14 mounted to the frame 12 and preferably at least in part housed within a frame cavity 15 defined by the frame 12.

The lock mechanism 14 preferably includes a trigger 16, a hammer assembly 18 including a hammer 20 and a sear or hammer cocking lever 22, a mainspring 24, a stirrup 26 connecting the mainspring 24 to the hammer 20, and a rebound slide 28.

Figure 1A:
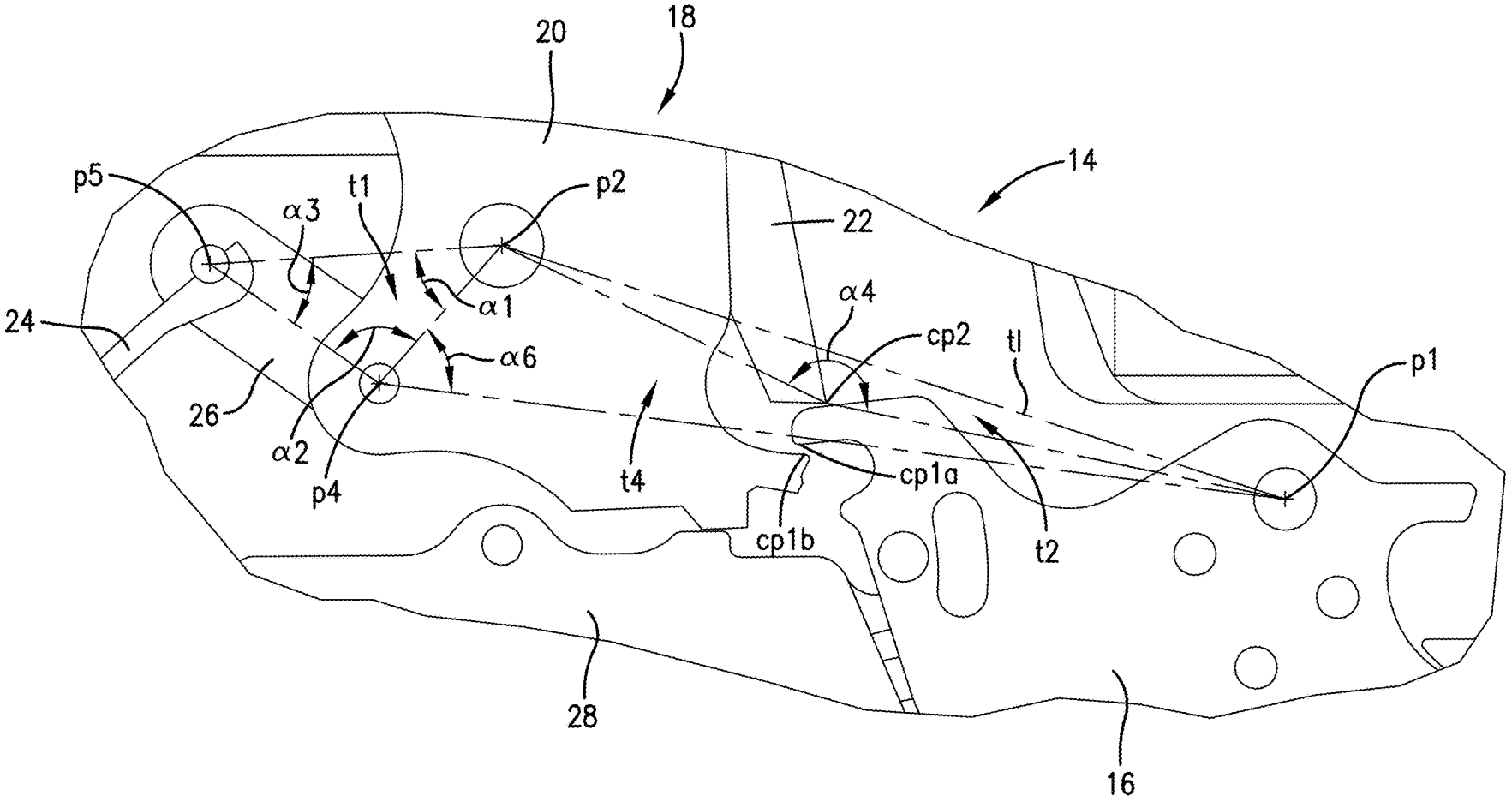
Fig. 1A. PRIOR ART
FIG. 1A is an enlarged view of a portion of the lock mechanism of the prior art firearm as shown in FIG. 1.
Figure 2:
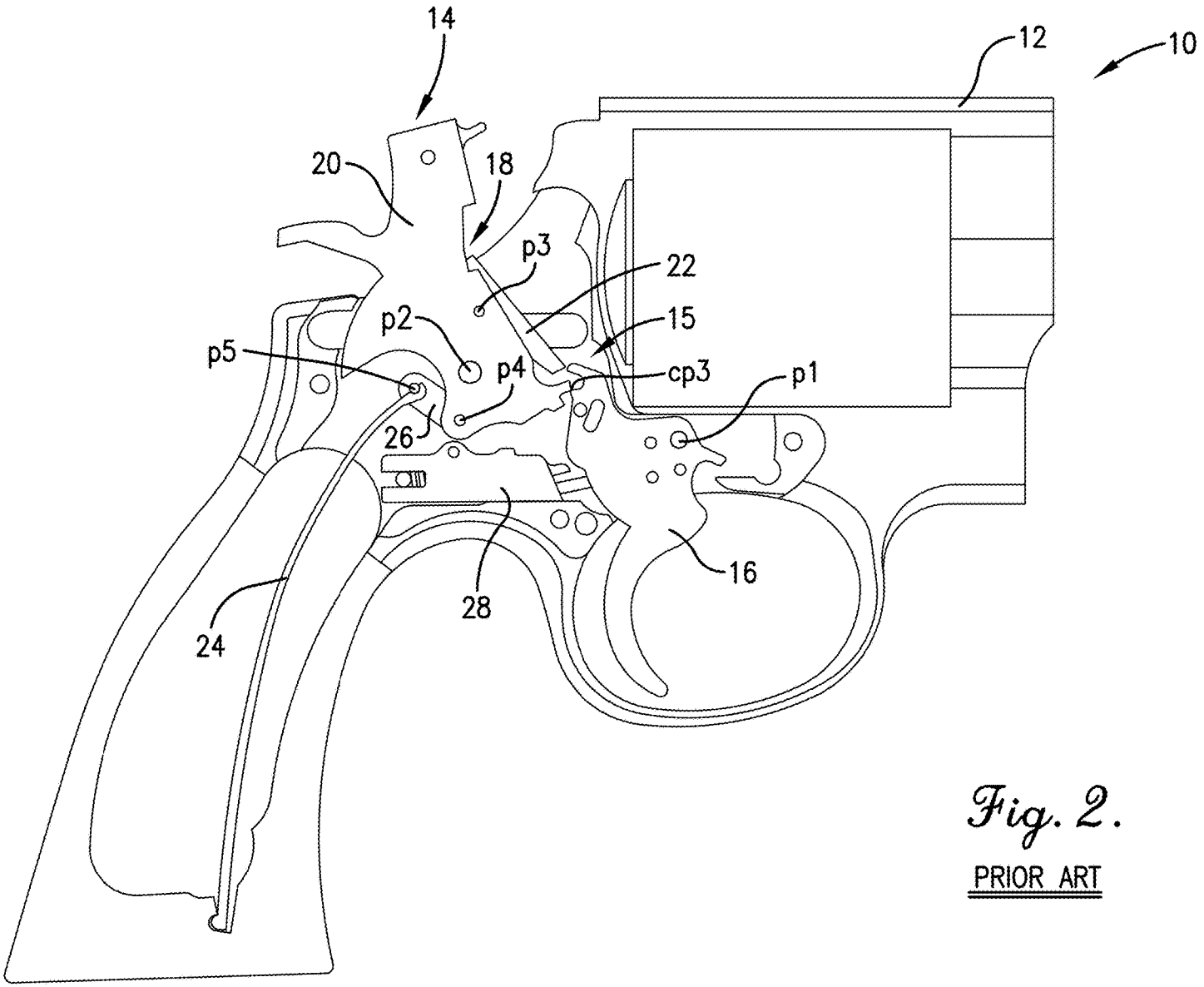
Fig. 2. PRIOR ART
FIG. 2 is a partially sectioned side view similar to FIG. 1, but showing the prior art lock mechanism in an imminent release state.
Figure 2A:
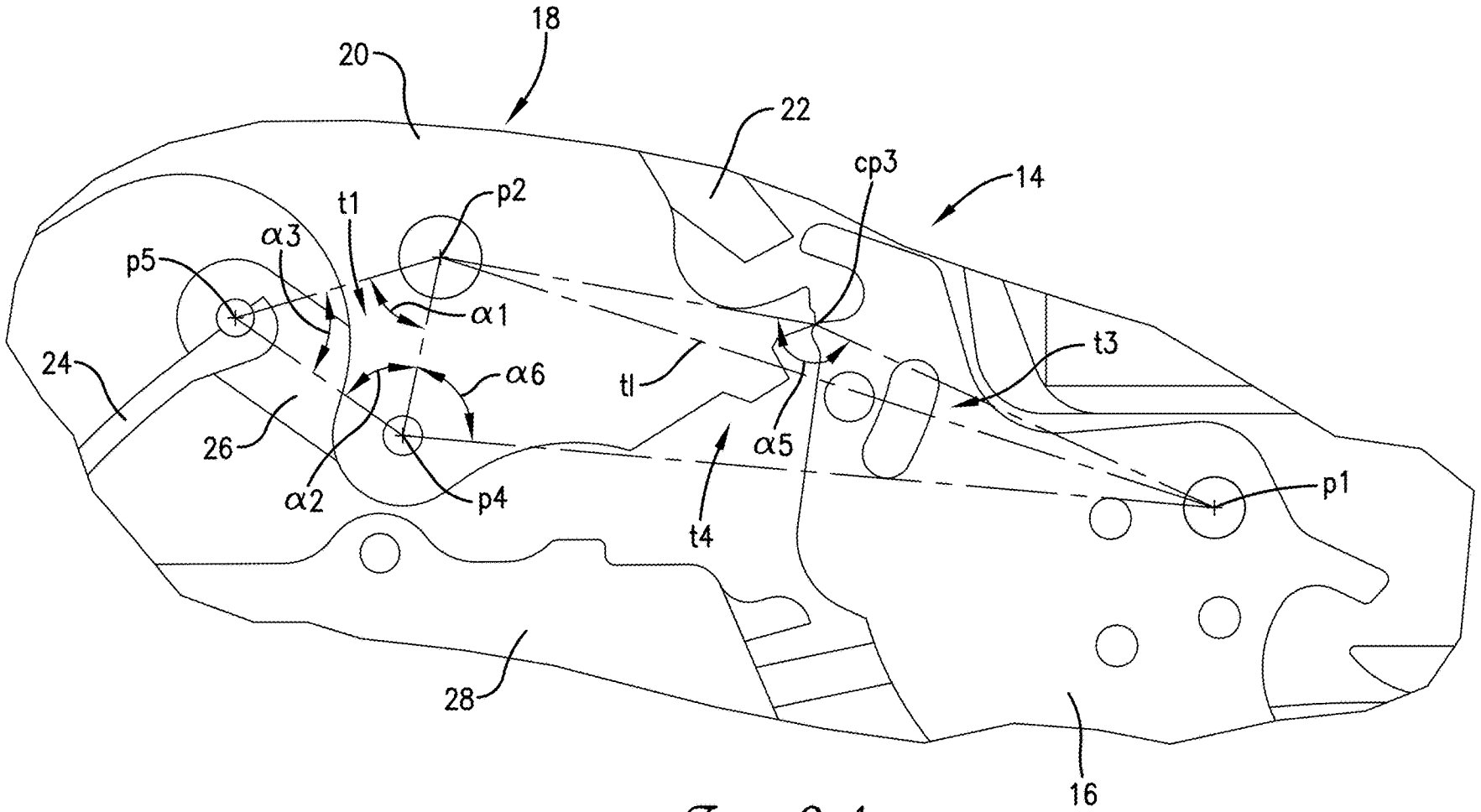
Fig. 2A. PRIOR ART
FIG. 2A is an enlarged view of a portion of the lock mechanism of the prior art firearm as shown in FIG. 2.

The lock mechanism 14 is incrementally or continuously shiftable into and through a variety of states or configurations, including an initial contact state, as shown in FIGS. 1 and 1A, and an imminent release state, as shown in FIGS. 2 and 2A.

The trigger 16 is pivotable about a trigger pivot point p1. The hammer 20 is pivotable about a hammer pivot point p2. The sear or hammer cocking lever 22 is preferably attached to the hammer 20 at the sear connection point p3. The stirrup 26, which may also be referred to as a hammer link, is pivotably connected to the hammer 20 at a stirrup pivot point p4. The mainspring 24 is connected to the stirrup 26 at a mainspring connection point p5.

As will be readily understood by those of ordinary skill in the art, the sear or hammer cocking lever 22 is preferably attached to the hammer 20 at the sear connection point p3 so as to be selectively pivotable relative to the hammer 20. More particularly, it is preferred that pivoting of the sear 22 relative to the hammer 20 be restricted during shifting of the lock mechanism 14 from the initial contact state to the imminent release state, such that the hammer assembly 18 moves unitarily, but be allowed during "reset" of the lock mechanism 14 (e.g., as the components thereof return to their initial or resting positions after firing of the firearm 10).

In an initial resting state (not shown), the trigger 16 rests on and engages the hammer 20 at a resting trigger contact point cp1. Although such contact is not directly illustrated, the respective involved surface points cp1a and cp1b of the trigger 16 and the hammer 20 are referenced in FIG. 1A for convenience and clarity.

As illustrated in FIGS. 1 and 1A, in the initial contact state of the lock mechanism 14, the trigger 16 has pivoted clockwise about the trigger pivot point p1 to engage the sear 22 at a first hammer assembly contact point cp2.

As shown in FIGS. 2 and 2A, in the imminent release state of the lock mechanism 14, the trigger 16 has pivoted still further clockwise about the trigger pivot point p1, driving counterclockwise rotation of the hammer 20 about the hammer pivot point p2, and engages the hammer 20 at a second hammer assembly contact point cp3.

As will be discussed in greater detail below in comparison with and contrast to the present invention, the geometry of certain elements and/or aspects of the components of the lock mechanism 14 relative to the others is highly informative. Such geometry includes, for instance, a hypothetical stirrup triangle t1, a hypothetical sear triangle t2, a hypothetical trigger triangle t3, and a hypothetical stirrup proximity triangle t4.

The stirrup triangle t1 is defined by the hammer pivot point p2, the stirrup pivot point p4, and the mainspring connection point p5. The stirrup triangle t1 thus defines three (3) internal angles referred to herein as the hammer angle $\alpha 1$, the stirrup angle $\alpha 2$, and the spring angle $\alpha 3$.

As shown in FIG. 1A, the sear triangle t2 is defined by the hammer pivot point p2, the trigger pivot point p1, and the first hammer assembly contact point cp2 (i.e., the contact point between the trigger 16 and the sear 22) when the lock mechanism 14 is in the initial contact state.

The hammer pivot point p2, the trigger pivot point p1, and the first hammer assembly contact point cp2 preferably cooperatively define a trigger-to-sear angle $\alpha 4$ having the first hammer assembly contact point cp2 as a vertex thereof.

The trigger triangle t3 is initially defined by the hammer pivot point p2, the trigger pivot point p1, and the second hammer assembly contact point cp3 (i.e., the contact point between the trigger 16 and the hammer 20) when the lock mechanism 14 enters a contact shifting state (not illustrated) but, as shown in FIG. 2A, continues to be defined in the imminent release state.

The hammer pivot point p2, the trigger pivot point p1, and the second hammer assembly contact point cp3 preferably cooperatively define a trigger-to-hammer angle $\alpha 5$ having the second hammer assembly contact point cp3 as a vertex thereof.

A straight hypothetical toggle line t1 extends between and interconnects the hammer pivot point p2 and the trigger pivot point p1 (thus forming one side of the sear triangle t2, as shown in FIG. 1A, and one side of the trigger triangle t3, as shown in FIG. 2A).

As will be discussed in greater detail below, the trigger-to-hammer angle $\alpha 5$ might alternatively be understood in relation to the toggle line t1 as being a contact point proximity angle $\alpha 5$.

The stirrup proximity triangle t4 is cooperatively defined by the trigger pivot point p1, the hammer pivot point p2, and the stirrup pivot point p4. The toggle line t1 thus forms one side of the stirrup proximity triangle t4.

A stirrup pivot proximity angle $\alpha 6$ is cooperatively defined by the hammer pivot point p2, the stirrup pivot point p4, and the trigger pivot point p1, with the stirrup pivot point p4 being the vertex of the stirrup pivot proximity angle $\alpha 6$.

Overview: Preferred Embodiment of Present Invention

Figure 3:
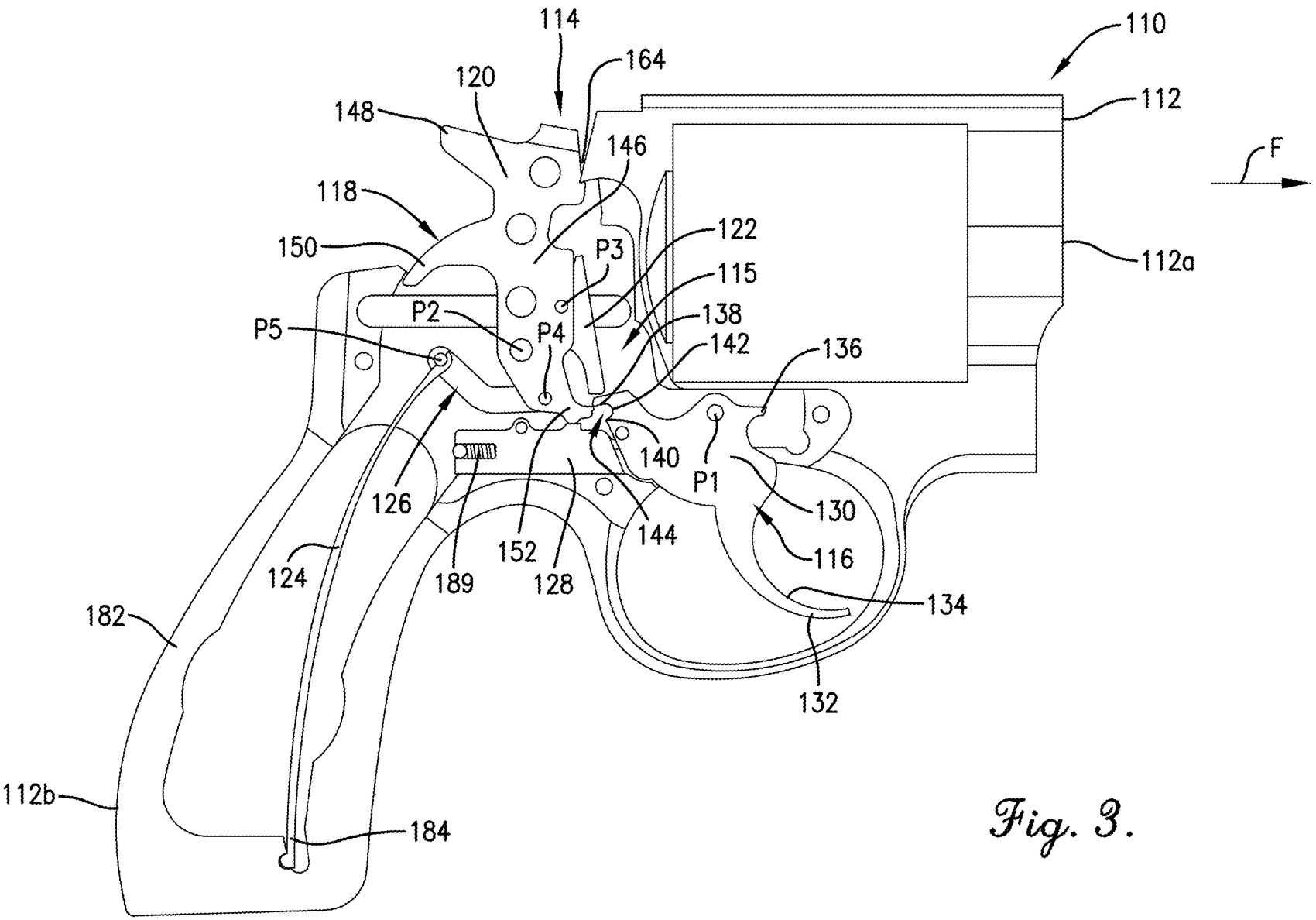
FIG. 3 is a partially sectioned side perspective view of a firearm in accordance with a preferred embodiment of the present invention, with the lock mechanism in a resting state.

With initial reference to FIG. 3, a firearm 110 in accordance with a preferred embodiment of the present invention is illustrated. The firearm 110 includes a frame 112 defining a front margin 112*a* and a back margin 112*b* of the firearm 110. A firing direction F is defined from the back margin 112*b* to the front margin 112*a*. The firing direction F may also be referred to in the preferred, illustrated embodiment, as "forward" or other similar terminology (e.g., frontward, etc.), whereas the opposite direction may be referred to as "backward" or other similar terminology (e.g., rearward, aftward, etc.), so as to be along a "fore-aft" direction, etc. Opposing "upward" and "downward" directions may also be defined orthogonally to the forward and backward directions. With continued reference to FIG. 3, for instance, the upward direction should be understood as toward the top of the figure, whereas the downward direction is toward the bottom thereof. In a general sense, "lateral" directions should be understood to be those in a plane orthogonal to that in which the upward and downward directions are defined. (Thus, forward and backward are lateral directions in the present sense.)

The firearm 110 further includes a lock mechanism 114 mounted to the frame 112 and preferably at least in part housed within a frame cavity 115 defined by the frame 112. The lock mechanism 114 preferably includes a trigger 116, a hammer assembly 118 including a hammer 120 and a sear or hammer cocking lever 122, a mainspring 124, a stirrup 126 connecting the mainspring 124 to the hammer 120, and a rebound slide 128.

As will be discussed in greater detail below, the lock mechanism 114 is incrementally or continuously shiftable into and through a variety of states or configurations, key ones of which are illustrated and described in detail herein. Initially, however, an overview of the structural components of the lock mechanism 114 is provided to facilitate a better understanding of their interactions during shifts between various aforementioned key configurations.

It is particularly noted that descriptions and illustrations of numerous components of the firearm 110 are omitted herein for the sake of clarity and brevity. Such components will be well known to those of ordinary skill art and include, but are not limited to, the cylinder, the hammer block, the hand, and various springs and levers.

It is also noted that, although the illustrated and described firearm 110 is a revolver, aspects of the present invention are applicable to a variety of firearm types, including but not limited to rifles, shotguns, pistols, etc.

Turning now to components of the lock mechanism 114, the trigger 116 is pivotable about a trigger pivot point P1. The trigger 116 includes a trigger body 130 and a lever 132 extending generally downward from the trigger body 130. The lever 132 is preferably configured for engagement with a user's finger, although other means of engagement may also or alternatively occur. In the illustrated embodiment, for instance, the lever 132 extends downward from the trigger body 130 and curves forward to provide a curved or C-shaped forwardly disposed trigger surface 134.

The trigger body 130 preferably defines the trigger pivot point P1 in an upper portion thereof, although certain alternate positions fall within the scope of some aspects of the present invention. A cylinder stop actuator nub 136 preferably extends forward from an upper portion of the trigger body 130. A sear contact projection 138 preferably extends backward from the upper portion of the trigger body 130. Still further, the trigger body 130 preferably defines a hammer contact ledge 140 disposed generally below the sear contact projection 138. The sear contact projection 138 and the hammer contact ledge 140 preferably cooperatively define a curved interconnecting surface 142 that in turn defines a trigger recess 144.

In a preferred embodiment, the hammer 120 is pivotable about a hammer pivot point P2. The hammer 120 includes a hammer body 146 defining the hammer pivot point P2 in a lower portion thereof. The hammer 120 also preferably includes an optional upper cocking spur 148 for facilitating manual cocking of the hammer 120, an intermediately disposed guide spur 150, and a lower trigger contact projection 152. The trigger contact projection 152 includes an upper lip or nose 154 defining an upper trigger rest surface 156, an intermediate portion 158 defining a single-action cocking notch 159 (FIG. 7B and others) and an angled cam surface 160, and a lower rebound seat 162. (As will be readily understood by those of ordinary skill in the art, the single-action cocking notch 159 is configured for use in a single-action mode but will conventionally play no role in a double-action mode. Furthermore, it is permissible according to some aspects of the present invention for the single-action cocking notch to be omitted entirely, such as in a double-action only firearm.)

The hammer body 146 preferably defines an impact face 164 configured to engage a primer (not shown) for initiating propulsion or launch of a projectile from the firearm 110 in the firing direction F. It is noted that the hammer may include an integral firing pin (not shown) for contacting the primer, or the firing pin might instead be housed in the frame. It is also noted that, in accordance with the previously described variety of permissible firearm types, the projectile might itself be a bullet (as appropriate for the illustrated revolver-type firearm 110), shot from a shell, etc. That is, the present invention is not limited by the type of ammunition associated with the firearm.

The hammer body 146 preferably defines the hammer pivot point P2 in a lower portion thereof. The hammer body 146 further preferably defines a sear connection point P3 in an intermediate portion thereof. Still further, the hammer body 146 preferably defines a stirrup pivot point P4 in a lower portion thereof.

The sear or hammer cocking lever 122 is preferably attached to the hammer 120 at the sear connection point P3 so as to be selectively pivotable relative to the hammer 120. More particularly, it is preferred that pivoting of the sear 122 relative to the hammer 120 be restricted during shifting of the lock mechanism 114 from the initial contact state to the imminent release state, such that the hammer assembly 118 moves unitarily, but be allowed during "reset" of the lock mechanism 114 (e.g., as the components thereof return to their initial or resting positions after firing of the firearm 110).

The sear 122 preferably is at least substantially disposed forward of the hammer body 146 and includes a leg 166 extending toward the sear contact projection 138 of the trigger 116. The leg 166 preferably defines a trigger contact surface 168.

The stirrup 126, which may also be referred to as a hammer link, preferably includes a hammer portion 170 pivotably connected to the hammer 120 at the stirrup pivot point P4 and a mainspring portion 172 operably connected to the mainspring 124. The hammer portion 170 and the mainspring portion 172 are each preferably straight and engage one another to form an obtusely angled elbow 174. More particularly, the hammer portion 170 preferably extends generally in the fore-aft direction when the lock mechanism is in the resting state of FIGS. 3, 4, and 4A. The mainspring portion 172 preferably extends upwardly and rearwardly from a rear edge of the hammer portion 170. Alternative stirrup shapes fall within the scope of some aspects of the present invention, however. For instance, in some embodiments, the stirrup might instead be straight or curved.

Preferably, the mainspring portion 172 of the stirrup 126 defines a mainspring pivot pin 176. An upper end 178 of the mainspring 124 includes a hook 180 that in part encircles the mainspring pivot pin 176 to connect the mainspring 124 to the stirrup 126 at a mainspring connection point P5.

The mainspring 124 preferably extends generally downward through a grip portion 182 of the frame 112. A lower end 184 of the mainspring 124 is secured relative the frame 112 to facilitate generation of a spring force that is transferred to the hammer 120 through the stirrup 126. Such force is thereafter transferred through the hammer 120 to the trigger 116. As will be readily apparent to those of ordinary skill in the art, such force is counteracted by the force applied to the trigger surface 134 until the imminent release state is reached.

The rebound slide 128 is preferably disposed below the stirrup 126 and the hammer 120, and rearward of the trigger 116. The rebound slide 128 preferably includes a rebound slide body 186 and an upwardly projecting platform 188 on which the rebound seat 162 of the hammer 120 rests.

The rebound slide 128 preferably includes a rebound spring 189 and defines a spring cavity 190 configured to receive the rebound spring 189. The rebound slide 128 is preferably operably interconnected to the trigger 116 such that the rebound slide 128 urges the trigger 116 back into its initial position (see, for instance, FIG. 3) after the trigger 116 has been fully shifted to facilitate firing.

Lock Mechanism: Resting State

Figure 4:
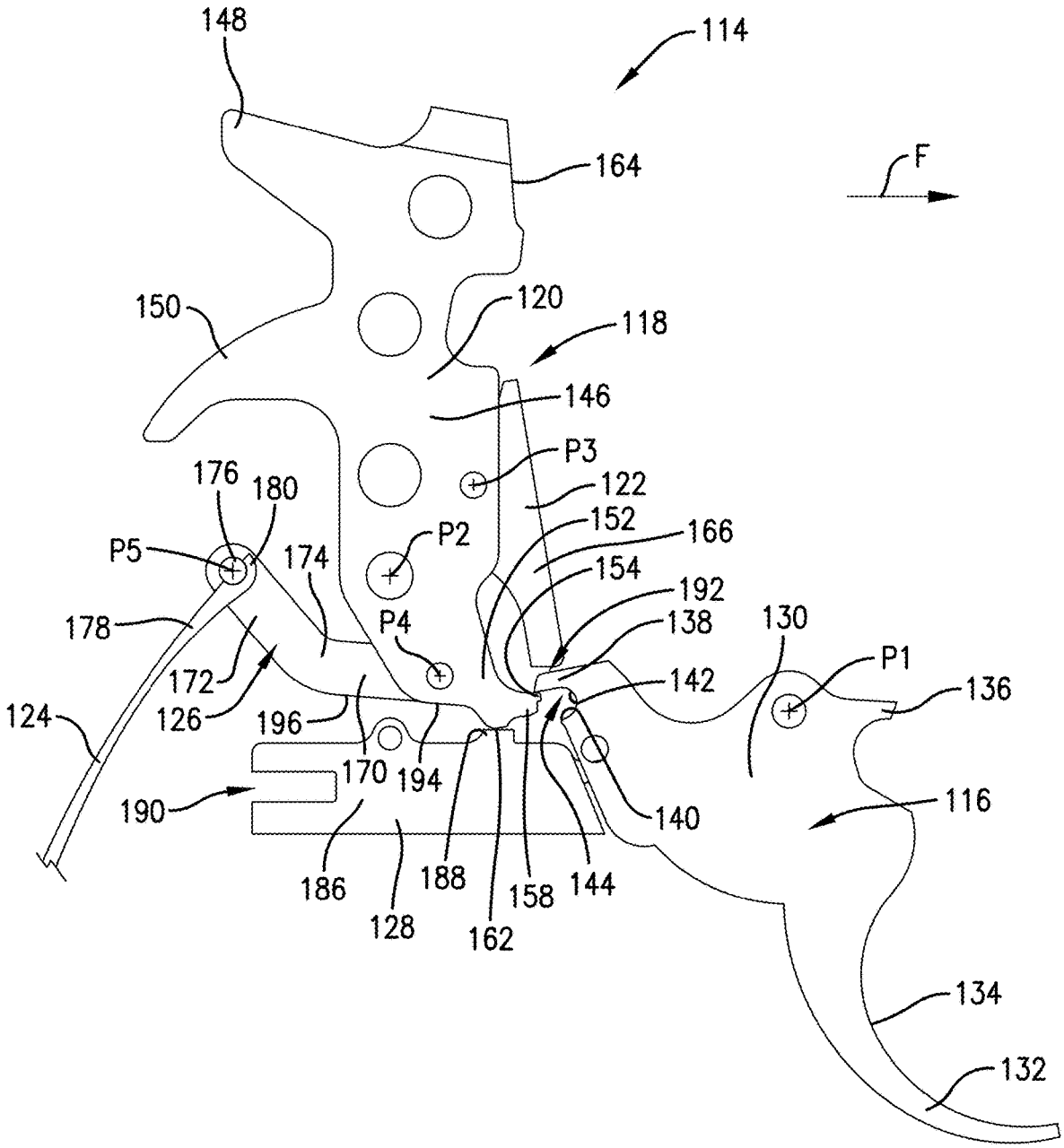
FIG. 4 is an enlarged, sectioned side view of the firearm of FIG. 3, particularly illustrating the lock mechanism in the resting state.
Figure 4A:
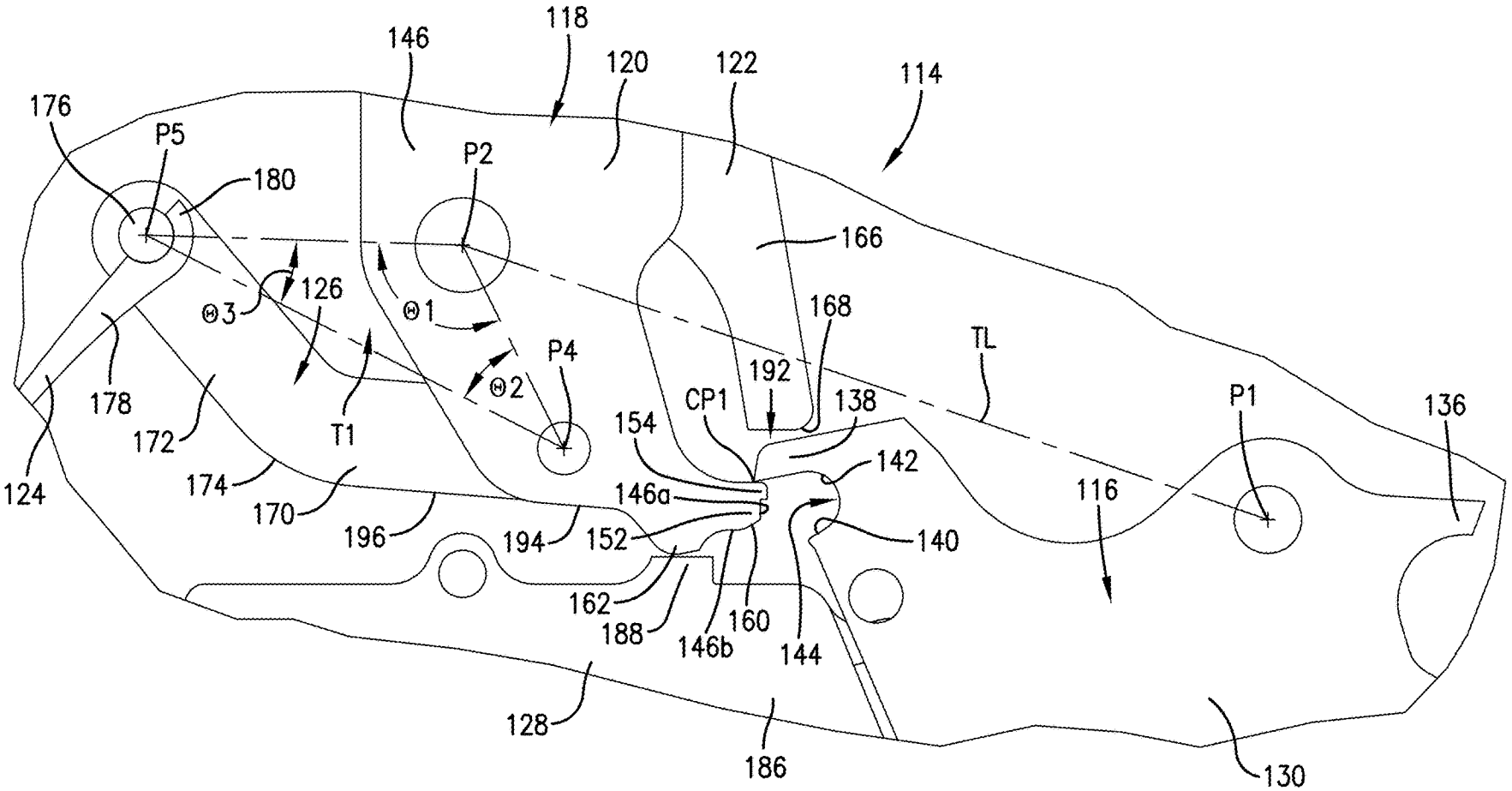
FIG. 4A is a further enlarged view of a portion of the lock mechanism of FIG. 4, in the resting state.

FIGS. 3, 4, and 4A illustrate an initial or resting state of the lock mechanism 114. The lever 132 of the trigger 116 is in its forward-most position. Conversely, the sear contact projection 138 of the trigger 116 is in its rearmost and lowest position. The sear contact projection 138 is spaced slightly from the sear 122 such that a gap 192 is defined between the trigger 116 and the hammer assembly 118. In the illustrated embodiment, the sear contact projection 138 rests on the trigger rest surface 156 of the hammer 120 at a resting trigger contact point CP1. However, such contact is not required.

The rebound slide 128 is disposed immediately adjacent the trigger 116.

The hammer 120 is at least generally vertically oriented. An undersurface 194 of the hammer 120 extends generally along the fore-aft direction, preferably (but not necessarily) with a slight downward slope toward the fore direction. The rebound seat 162 of the hammer 120 rests on the platform 188 defined by the rebound slide 128.

The hammer portion 170 of the stirrup 126 extends generally forward in the fore-aft direction, with a slight downward slope in the fore direction, such that a lower face 196 thereof at least substantially aligns with the undersurface 194 of the hammer 120.

Lock Mechanism: Initial Contact State

Figure 5:
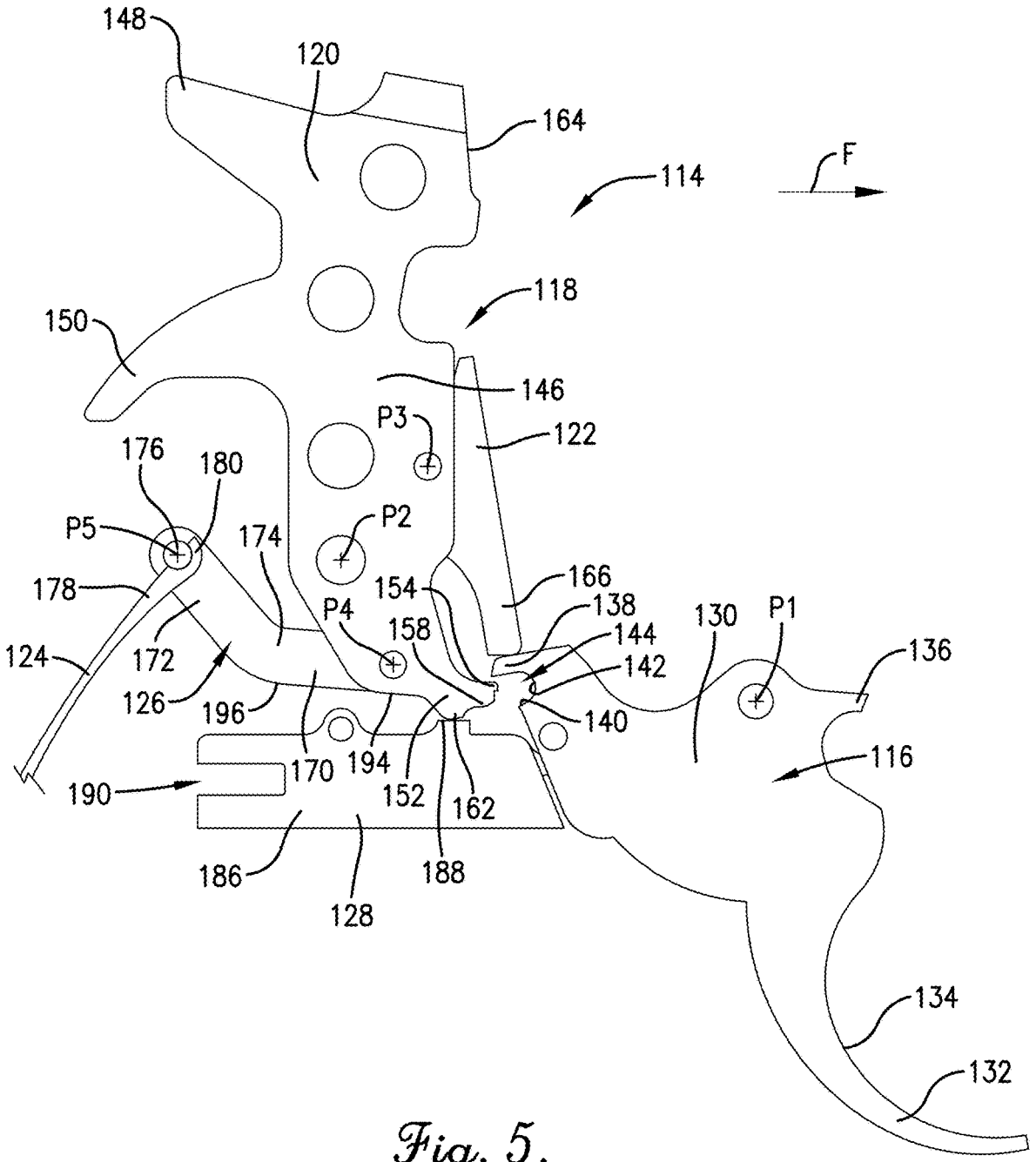
FIG. 5 is an enlarged, sectioned side view of the firearm similar to that of FIG. 4, but showing the lock mechanism in an initial contact state.
Figure 5A:
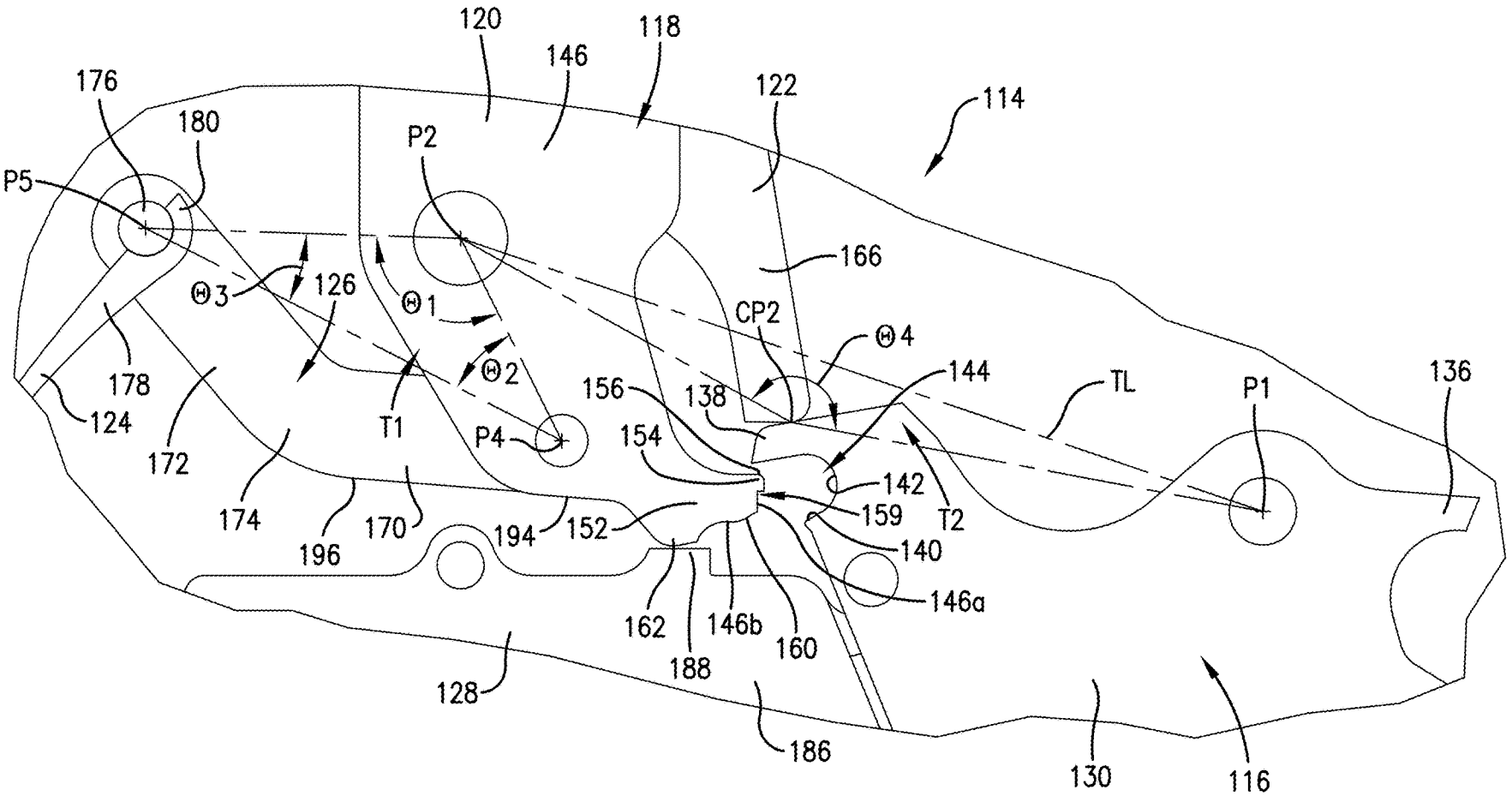
FIG. 5A is a further enlarged view of a portion of the lock mechanism of FIG. 5, in the initial contact state.

An initial contact state is illustrated in FIGS. 5 and 5A. More particularly, as a result of pressure applied to the trigger surface 134 of the trigger lever 132, the trigger 116 has pivoted slightly clockwise about the trigger pivot point P1. This has resulted in upward shifting of the sear contact projection 138 out of contact with the upper trigger rest surface 156 of the hammer 120 and into contact with the trigger contact surface 168 of the leg 166 of the sear 122 at a first hammer assembly contact point CP2.

The remaining components remain as described above with reference to the initial or resting state, except for a very slight rearward shifting of the rebound slide 128.

Lock Mechanism: Contact Shifting State

Figure 6:
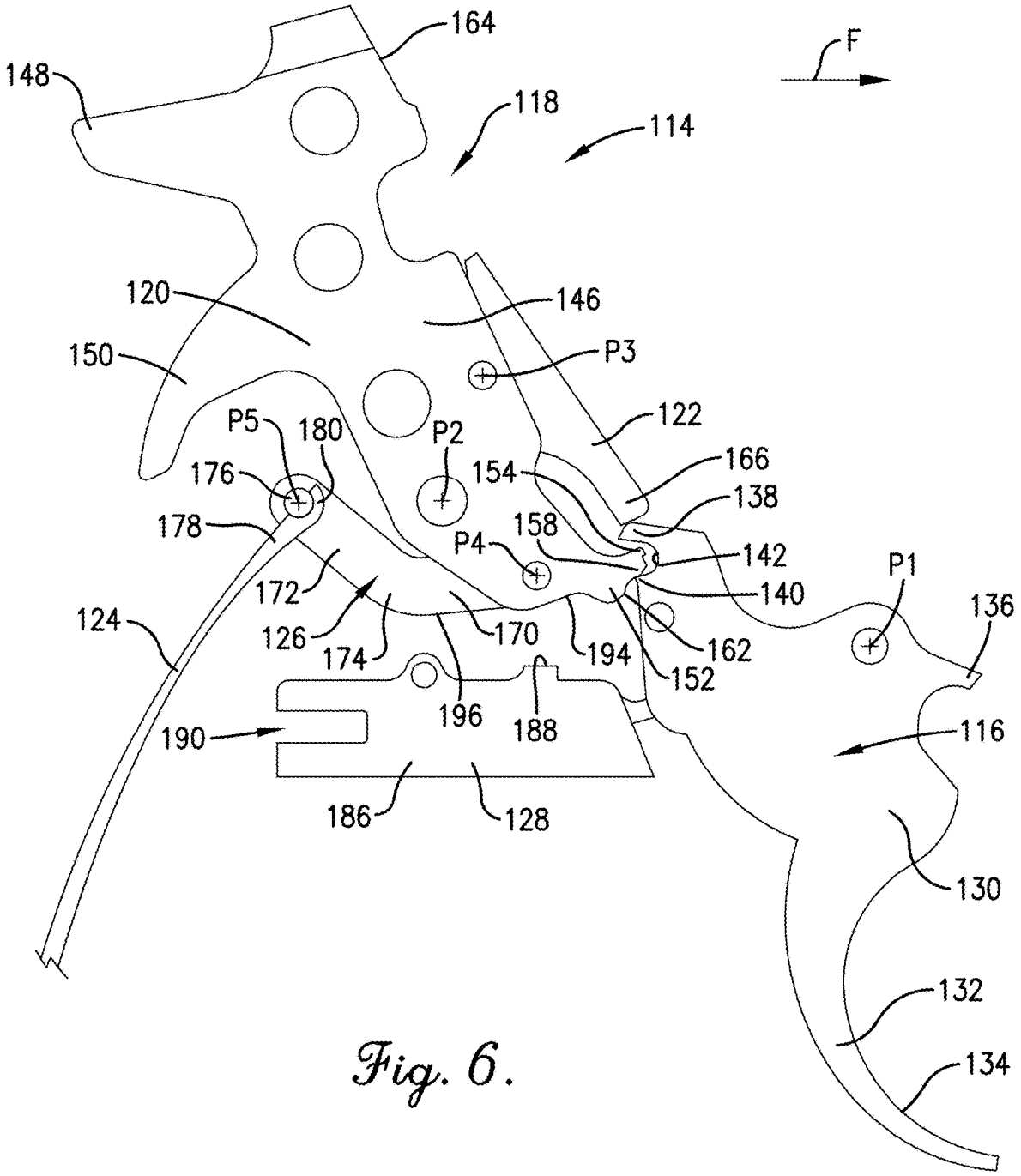
FIG. 6 is an enlarged, sectioned side view of the firearm similar to that of FIGS. 4 and 5, but showing the lock mechanism in a contact shifting state.
Figure 6A:
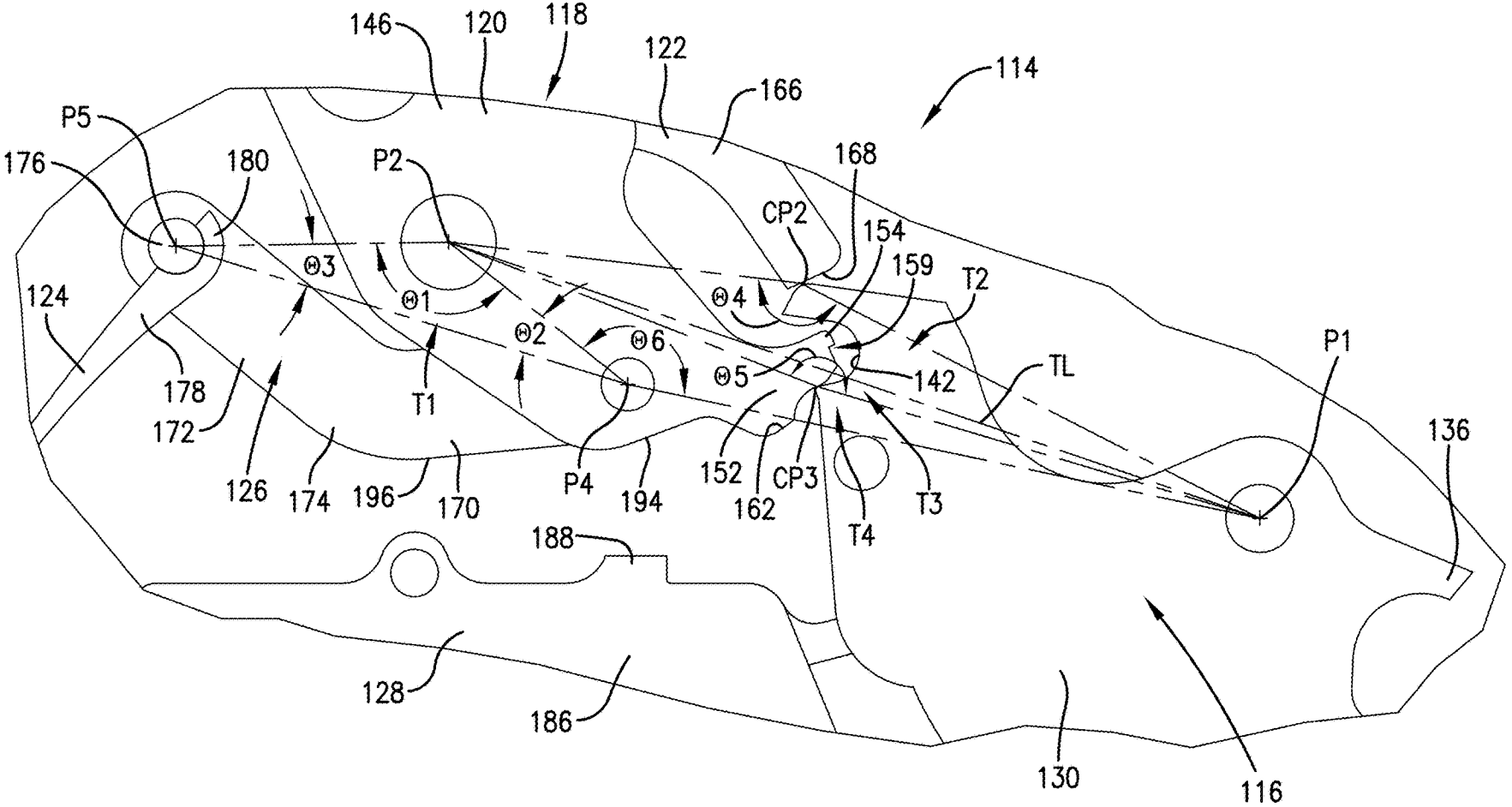
FIG. 6A is a further enlarged view of a portion of the lock mechanism of FIG. 6, in the contact shifting state.
Figure 6B:
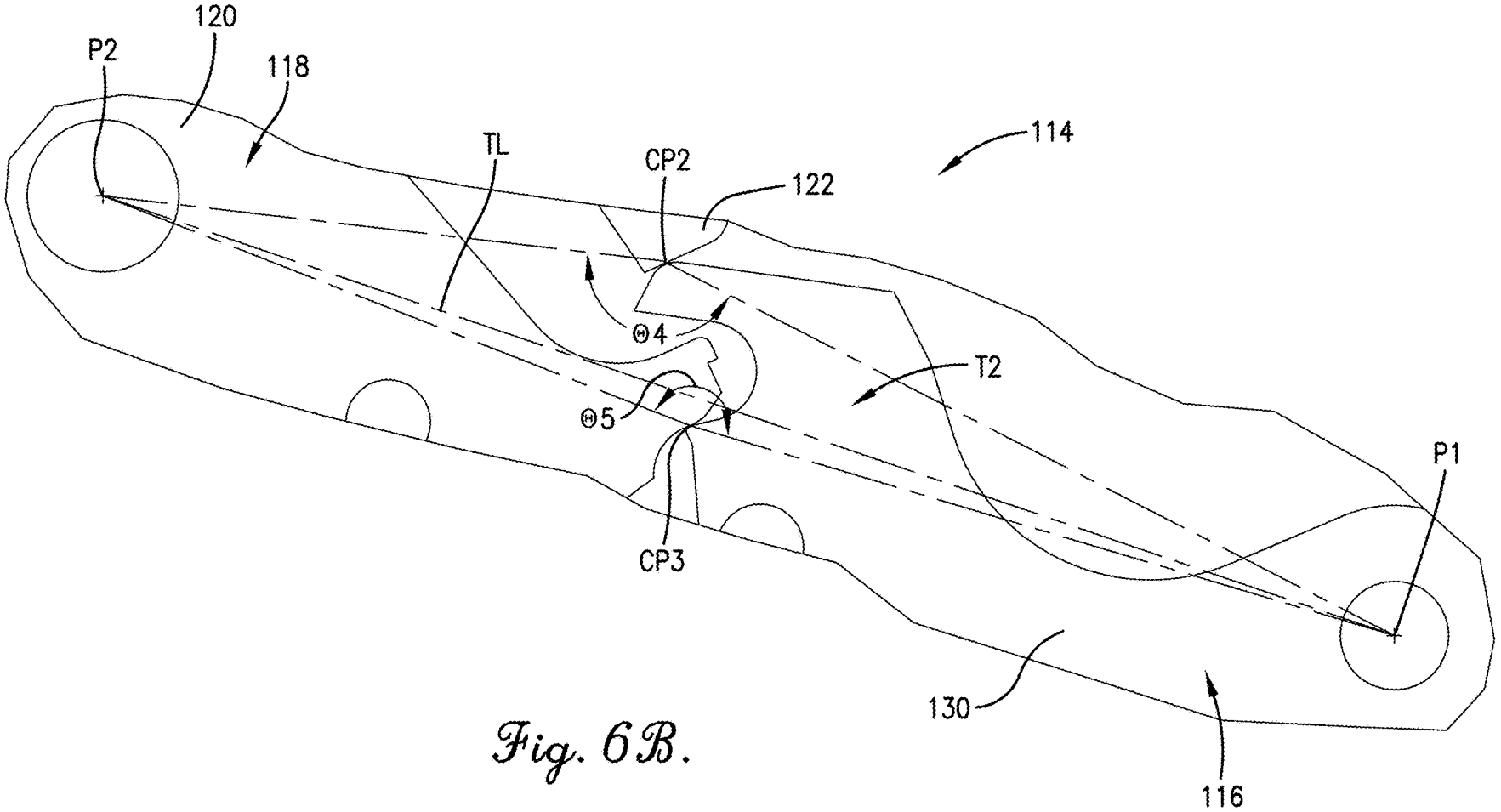
FIG. 6B is a still further enlarged view of a portion of the lock mechanism of FIG. 6, in the contact shifting state.

A contact shifting state is illustrated in FIGS. 6 and 6A. More particularly, continued pressure applied to the trigger surface 134 of the trigger lever 132 has caused further pivoting of the trigger 116 clockwise about the trigger pivot point P1. This has resulted in pivoting of the hammer 120 in a counter-clockwise direction (i.e., a direction opposite that of the trigger 116) about the hammer pivot point P2.

In greater detail, the sear contact projection 138 of the trigger 116 has applied generally upward forces to the sear 122 (at the first hammer assembly contact point CP2), which is connected to the hammer body 146 at the sear connection point P3. These forces are thus transferred to the hammer 120 and due to the geometries of the sear 122 and the hammer 120, result in the aforementioned counter-clockwise pivoting of the hammer 120 about the hammer pivot point P2.

It is noted that the concurrent pivoting motions of the trigger 116 and the sear 122 also result in a small shift in the relative position of the first hammer assembly contact point CP2. As shown in FIG. 5A, for instance, the contact point CP2 is initially disposed at the abutment of a forward end of the trigger contact surface 168 of the sear 122 with an intermediate portion of the sear contact projection 138 of the trigger 116. As the trigger 116 and the hammer assembly 118 pivot, however, the surface 168 "rolls" along the projection 138 such that the point of abutment therebetween—i.e., the contact point CP2—shifts rearwardly along the projection 138 and the surface 168. Thus, as shown in FIG. 6A, the contact point CP2 is disposed at the abutment of a rearward end of the trigger contact surface 168 of the sear 122 with rearward portion of the sear contact projection 138 of the trigger 116 when the lock mechanism 114 is in the contact shifting state. As will be readily apparent to those of ordinary skill in the art, "contact point" as used herein should thus be understood to refer to a point of engagement that, in some instances, may be shiftable along a range of potential contact.

The counter-clockwise pivoting of the hammer 120 about the hammer pivot point P2 results in generally upward and forward shifting of the trigger contact projection 152 thereof. The continued clockwise pivoting of the trigger 116 about the trigger pivot point P1 results in generally upward shifting of the hammer contact ledge 140 of the trigger 116. In the illustrated contact shifting state of FIGS. 6 and 6A, these concurrent shifts result in initial contact occurring between the hammer contact ledge 140 of the trigger 116 and the angled cam surface 160 of the trigger contact projection 152 of the hammer 120. This point of contact will be referred to herein as the second hammer assembly contact point CP3.

As will be apparent to those of ordinary skill in the art, the contact shifting state as shown in FIGS. 6 and 6A illustrates a "hand-off" or shifting of contact between the trigger 116 and the hammer assembly 118 from the first hammer assembly contact point CP2 (i.e., at the leg 166 of the sear 122) to the second hammer assembly contact point CP3 (i.e., at the trigger contact projection 152 of the hammer 120).

The rebound slide 128 preferably shifts further rearward as pushed by the trigger body 130.

The stirrup 126 preferably pivots slightly clockwise relative to the hammer 120 about the stirrup pivot point P4. That is, the mainspring portion 172 of the stirrup 126 moves closer to the hammer body 146. The lower face 196 of the stirrup and the undersurface 194 of the hammer 120 are preferably slightly offset from each other.

It is particularly noted that the motion of the stirrup 126 as the lock mechanism 114 shifts from the initial contact state to the contact shifting state results in loading of the mainspring 124. More particularly, the mainspring pivot pin 176 shifts forward and downward, resulting in forward and downward bending of the upper end 178 of the mainspring 124. This loading results in resistance to rearward pulling of the trigger lever 132 (or, alternatively stated, clockwise rotation of the trigger body 130) and associated pivoting of the hammer 120.

Lock Mechanism: Imminent Release State

Figure 7:
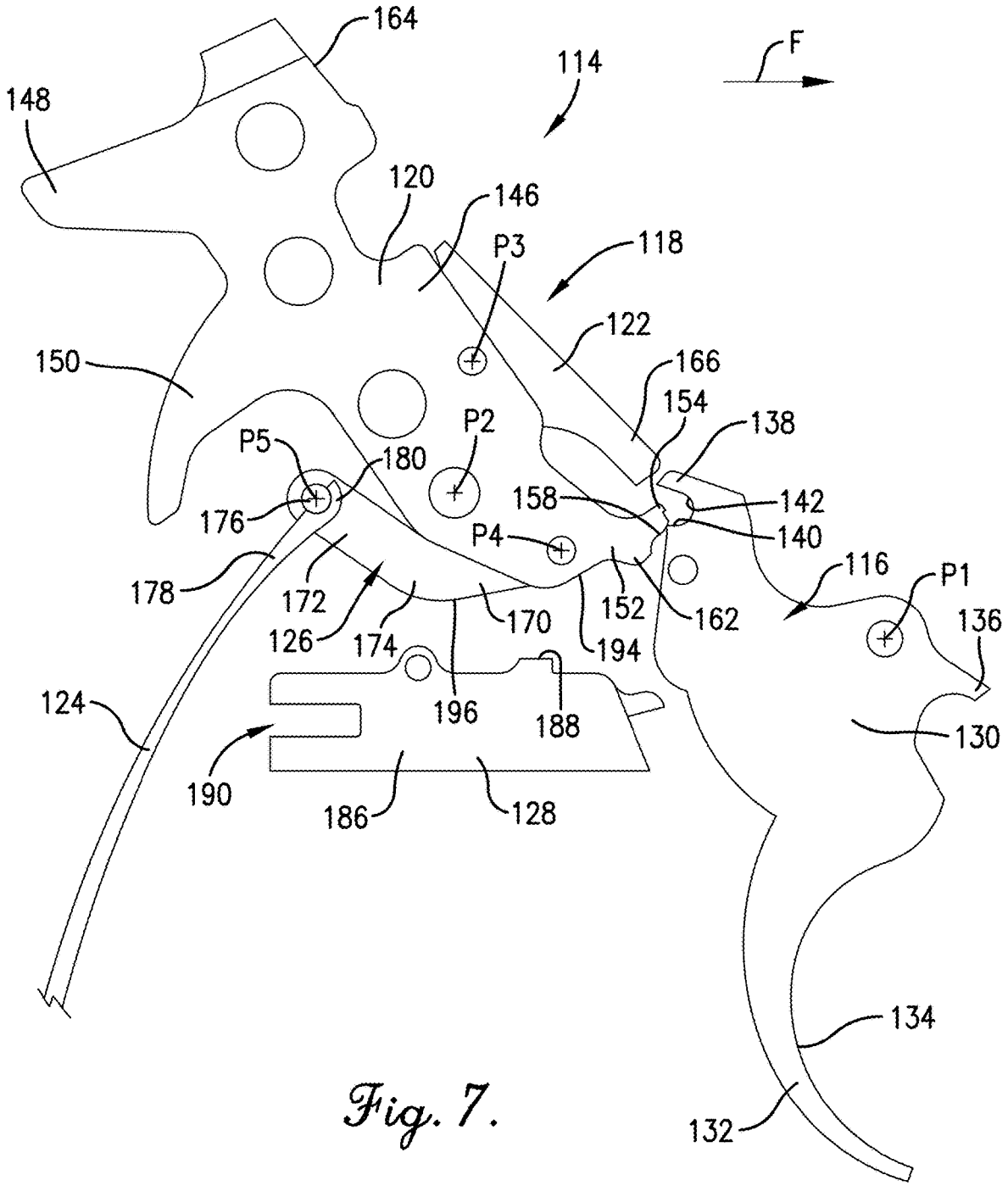
FIG. 7 is an enlarged, sectioned side view of the firearm similar to that of FIGS. 4-6, but showing the lock mechanism in an imminent release state.
Figure 7A:
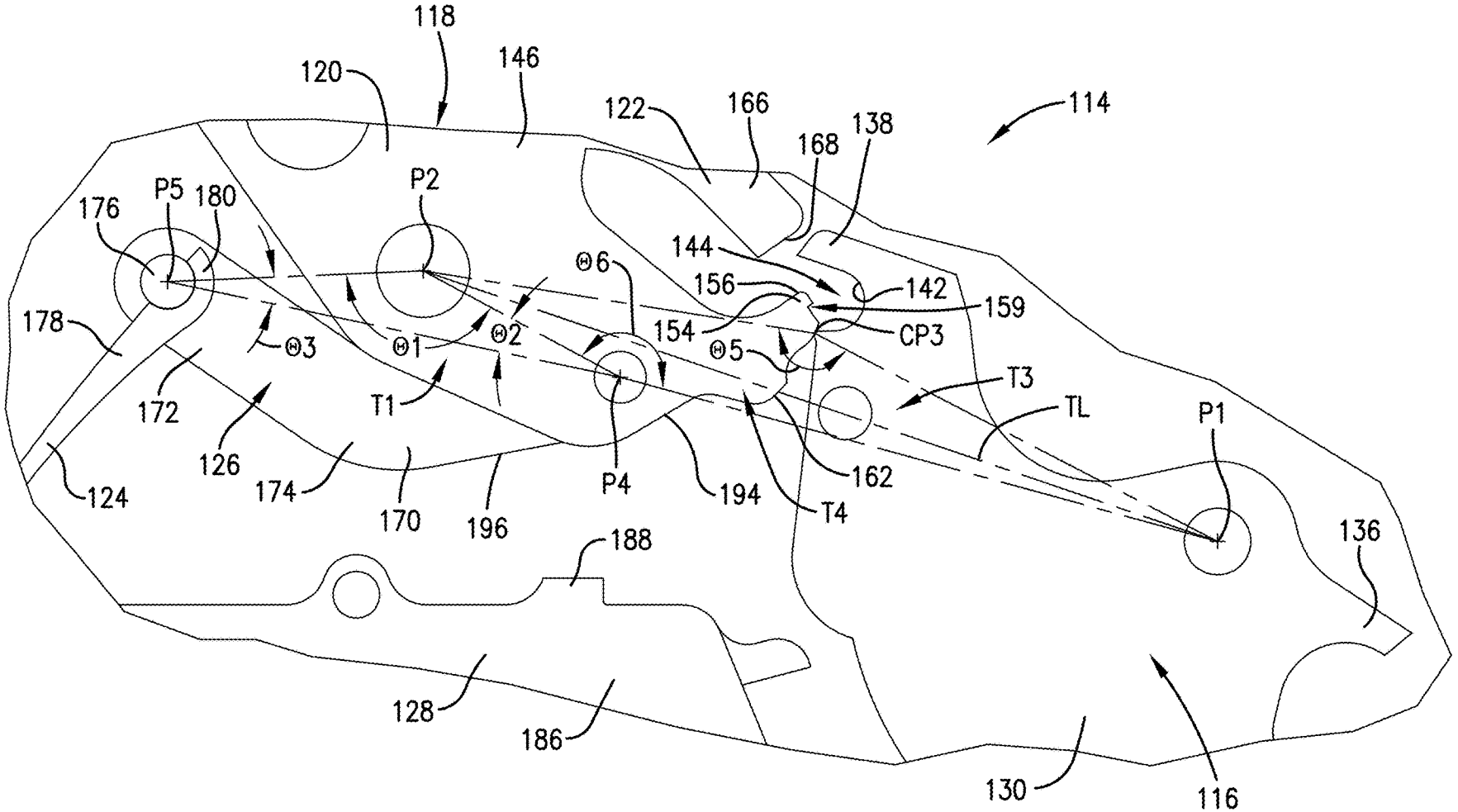
FIG. 7A is a further enlarged view of a portion of the lock mechanism of FIG. 7, in the imminent release state.
Figure 7B:
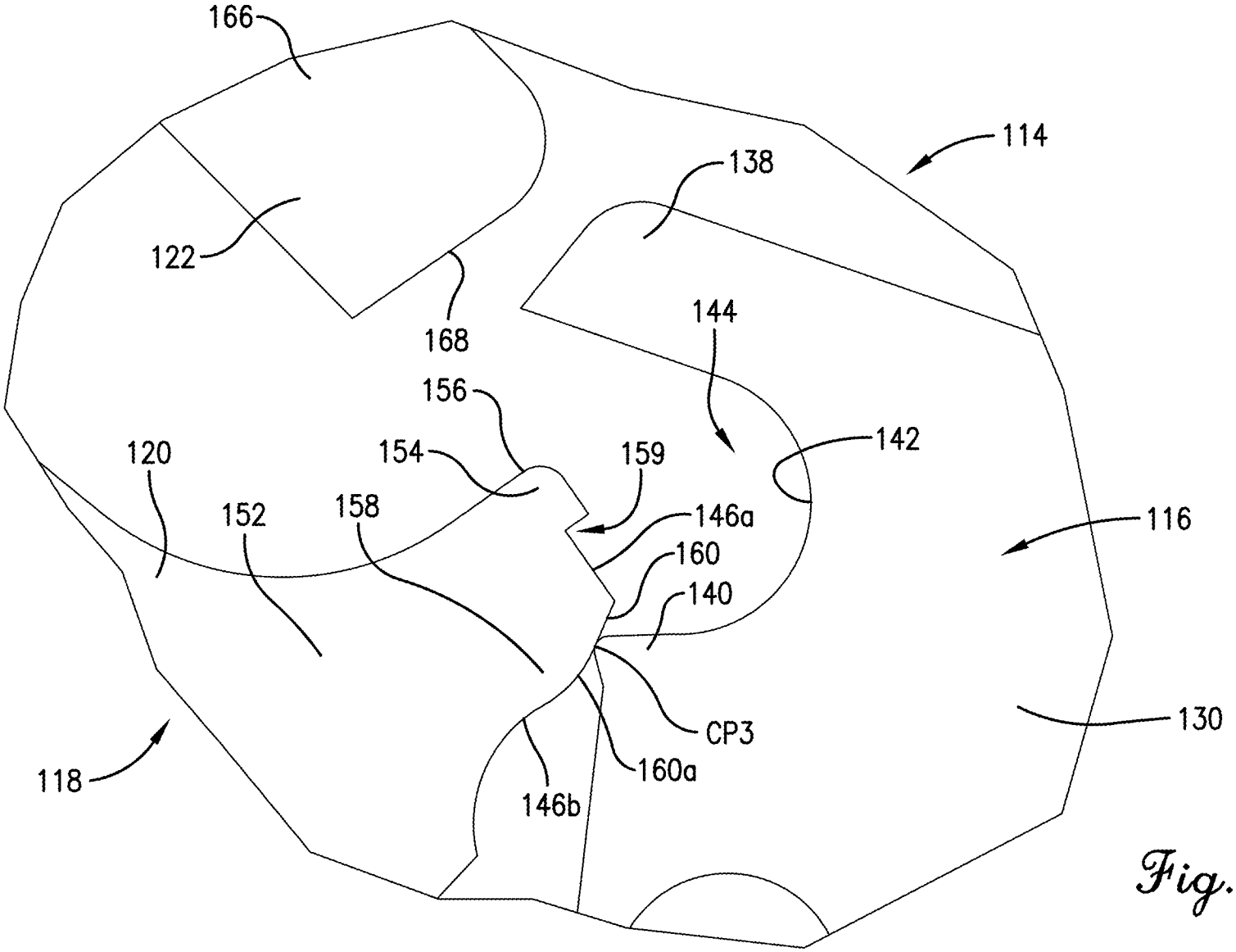
FIG. 7B is a still further enlarged view of the trigger-to-hammer contact point of the lock mechanism as shown in FIGS. 7 and 7A, in the imminent release state.

An imminent release state is illustrated in FIGS. 7, 7A, and 7B. More particularly, still further pressure applied to the trigger surface 134 of the trigger lever 132, in opposition to resistive forces from the mainspring 124, has caused further pivoting of the trigger 116 clockwise about the trigger pivot point P1. This has resulted in further generally upward shifting of the hammer contact ledge 140 of the trigger 116. Such shifting has applied further forces to the hammer 120 via the second hammer assembly contact point CP3 (i.e., between the hammer contact ledge 140 and the cam surface 160 of the hammer 120), resulting in further counterclockwise pivoting of the hammer 120 about the hammer pivot point P2.

Contact between the sear contact projection 138 and the sear 122 (i.e., at the first hammer assembly contact point CP2) has been broken.

In this state, the hammer 120 is in its rearmost position (i.e., at its maximum counter-clockwise rotational or pivotable position) in a double-action process or mode. It is noted that this position is substantially similar to, albeit slightly less rearward than, that which would be achieved via manual cocking (e.g., using the cocking spur 148 and, in turn, the single-action cocking notch 159) in a single-action process or mode.

The rebound slide 128 has further shifted rearward to its rearmost position.

The stirrup 126 has preferably pivoted even further slightly clockwise relative to the hammer 120 about the stirrup pivot point P4. That is, the mainspring portion 172 of the stirrup 126 has moved even closer to the hammer body 146. The lower face 196 of the stirrup and the undersurface 194 of the hammer 120 are again preferably slightly offset from each other.

The mainspring pivot pin 176 has shifted even farther forward and downward, resulting in still greater forward and downward bending of the upper end 178 of the mainspring 124. Resistance to rearward pulling of the trigger lever 132 (or, alternatively stated, clockwise rotation of the trigger body 130) and associated pivoting of the hammer 120 therefore continues.

It is noted that the specific geometry and orientation of the cam surface 160 is highly advantageous, facilitating smooth motion of the hammer 120 relative to the trigger 116, particularly as the lock mechanism 114 shifts from the contacting shifting state to the imminent release state (i.e., at times during which gradually shifting contact is made at the second hammer assembly contact point CP3, between abutting portions of the hammer contact ledge 140 and the cam surface 160). Furthermore, the specific geometry and orientation of the cam surface 160 facilitates maximization of the counter-clockwise range of motion of the hammer 120 (e.g., to its rearmost position in the imminent release state). This maximization of rearward or counter-clockwise rotation in turn maximizes the force imparted by the hammer after its forward fall, which will be described in detail below.

More particularly, as best shown in FIG. 7B, the hammer body 146 preferably defines a pair of generally orthogonal faces 146*a* and 146*b*, with the cam surface 160 extending between and interconnecting the faces 146*a* and 146*b*. Rounding/radiusing or chamfering at the intersections of the cam surface and the orthogonal faces is permissible, as is direct interfacing. In the illustrated embodiment, for instance, radiusing 160*a* (i.e., a gently curved surface 160*a*) is provided between the cam surface 160 and the face 146*b*. The angling of the cam surface 160, along with the radiusing 160*a*, facilitates smooth "rolling" and sliding of the hammer contact ledge 140 therealong from a relatively lower position of the second hammer assembly contact point CP3 in the contact shifting state (see FIG. 6A and others) to a relatively more upper position of the contact point CP3 in the imminent release state (see FIG. 7A and others).

Preferably the cam surface 160 is angled between about one hundred ten degrees (110°) and about one hundred thirty degrees (130° relative to the face 146*a*. Most preferably, the cam surface 160 is angled about one hundred twenty-one degrees (121°) relative to the face 146*a*.

Lock Mechanism: Firing State

Figure 8:
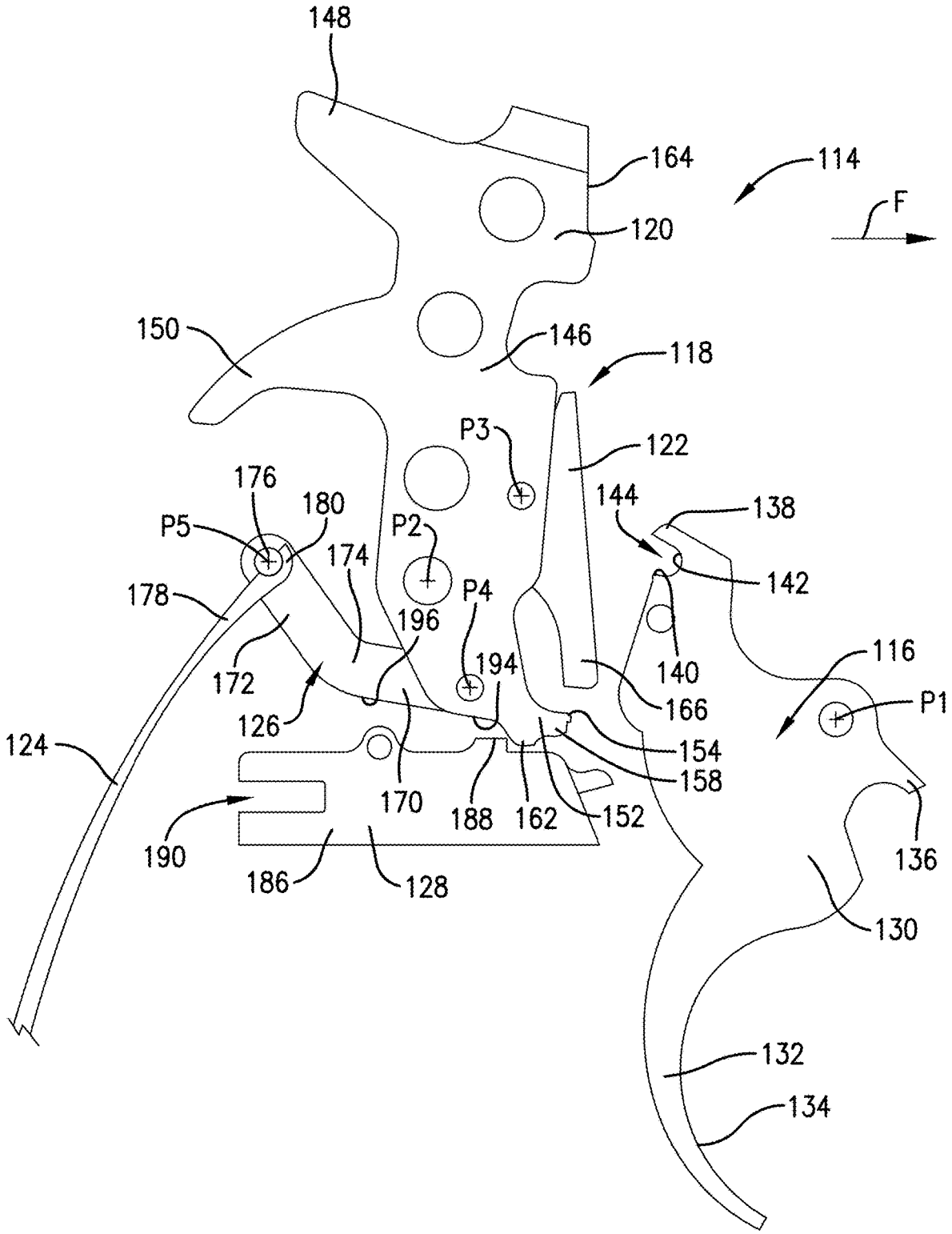
FIG. 8 is an enlarged, sectioned side view of the firearm similar to that of FIGS. 4-7, but showing the lock mechanism in a firing state.
Figure 8A:
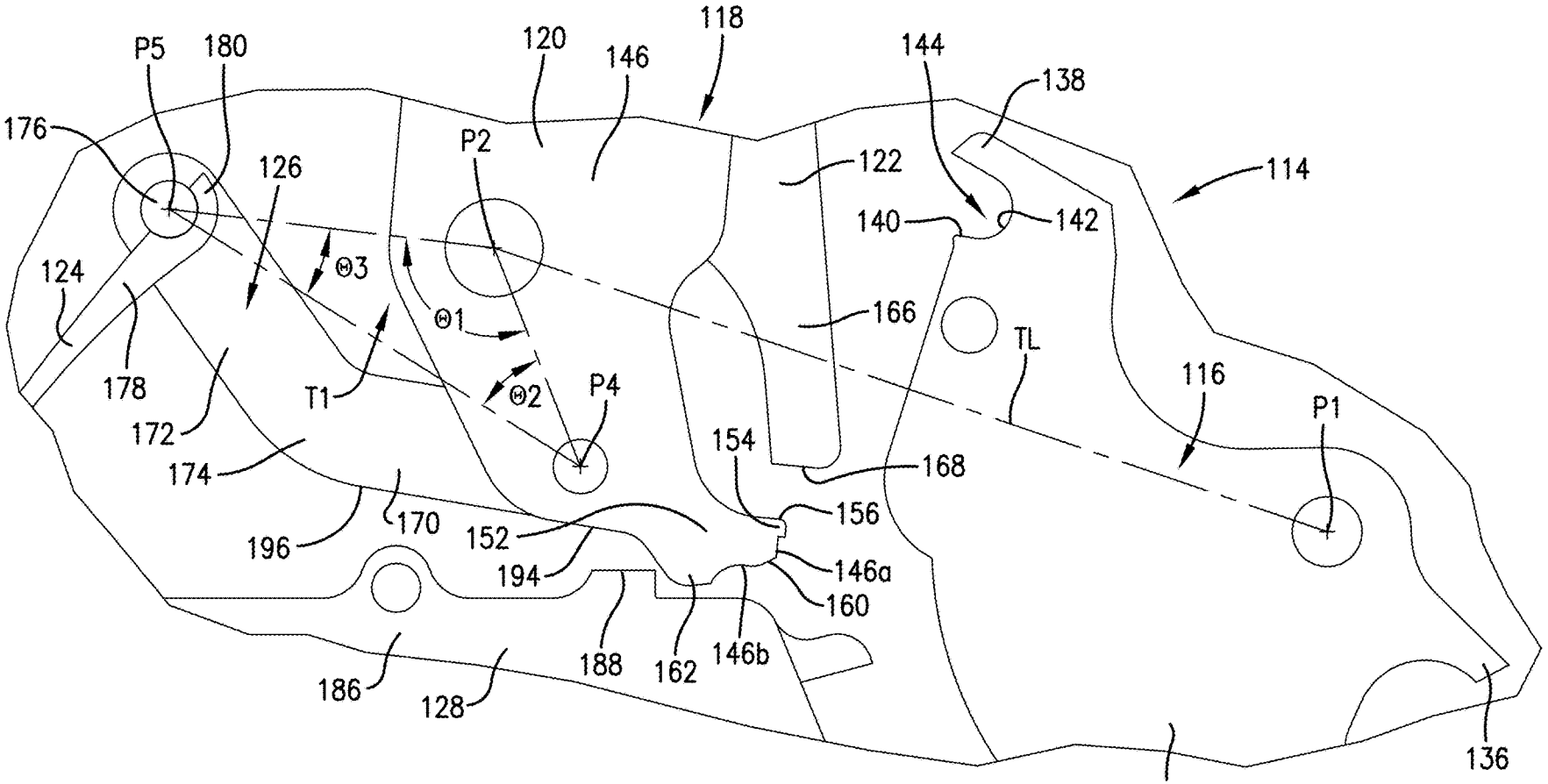
FIG. 8A is a further enlarged view of a portion of the lock mechanism of FIG. 8, in the firing state.

A firing state is illustrated in FIGS. 8 and 8A. More particularly, still further pressure applied to the trigger surface 134 of the trigger lever 132 has caused further pivoting of the trigger 116 clockwise about the trigger pivot point P1. This has resulted in even more upward shifting of the hammer contact ledge 140 of the trigger 116, which in turn has resulted in release of the cam surface 160 of the hammer 120. That is, contact has been broken at the second hammer assembly contact point CP3, precipitating consequent forward pivoting or "fall" of the hammer 120 in a clockwise direction about the hammer pivot point P2.

Such forward fall preferably results in forceful impact (i.e., engagement) of a primer (not shown) via the impact face 64 of the hammer 120, which in the illustrated embodiment is configured to strike a firing pin (not shown) housed within the frame 112. (It is permissible for the firing pin to instead project directly from the impact face of the hammer.) As noted previously, this impact in turn preferably leads to firing of a projectile (not shown) in the forward or firing direction F (i.e., along the fore-aft direction) by the firearm 110.

In the firing state, as illustrated, the trigger 116 has pivoted to its forward-most or clockwise most position. The hammer 120 has also pivoted to its forward-most or clockwise-most position.

It is noted that forces associated with hammer fall are primarily provided by release of energy from the mainspring 124, although other factors (including but not limited to gravity) may influence hammer fall without departing from the scope of some aspects of the present invention. More particularly, in the firing state, the mainspring 124 has just rapidly released its tension and thus shifted from its most deformed state (i.e., as shown in FIGS. 7 and 7A with regard to the imminent release state) back toward and just past its initial state, such that the upper end 178 thereof is in its rearmost and uppermost position. This rapid release of tension acts as the primary forceful driver of hammer fall and is most preferably sufficient to consistently enable the hammer 120 to activate the primer.

In the firing state, the rebound slide 128 preferably maintains its position from the imminent firing state, with the rebound seat 162 falling to a position forward of the platform 188.

In keeping with the release of the mainspring 124, the stirrup 126 in the firing state has pivoted slightly counter-clockwise relative to the hammer 120 about the stirrup pivot point P4. That is, the mainspring portion 172 of the stirrup 126 has moved away from the hammer body 146. Furthermore, the lower face 196 of the stirrup and the undersurface 194 of the hammer 120 preferably return into alignment with each other.

Lock Mechanism: Return to Resting State

Upon release of the trigger lever 132 by a user or, alternatively, upon sufficient reduction of pressure applied to the trigger surface 134, the rebound slide 128 will shift forward as urged by the compressed spring thereof (not shown) to "reset" the lock mechanism 114.

More particularly, the platform 188 of the rebound slide 128 will engage a rear face of the hammer rebound seat 162 and, upon forward shifting, cause counter-clockwise pivoting of the hammer 120 until the hammer 120 is in its original position, with the rebound seat 162 resting on top of the platform 188.

Furthermore, engagement of the rebound slide 128 with the trigger body 130 via a link (not illustrated) therebetween, combined with forward motion of the rebound slide 128, will result in counter-clockwise rotation of the trigger 116 back into its original position, in which the sear contact projection 138 of the trigger 116 preferably (but not necessarily) rests on the trigger resting surface 156 of the hammer 120 at the resting trigger contact point CP1.

Geometric and Force Analysis of Lock Mechanism

The above-described description of the shifting of the lock mechanism 114 through various states thereof is focused primarily on the broad interactions between the components of the lock mechanism 114. However, geometric analysis of certain elements and/or aspects of the components relative to the others is also highly informative.

Stirrup Triangle

Turning to FIGS. 4A, 5A, 6A, 7A, and 8A, for instance, a hypothetical stirrup triangle T1 is defined by the hammer pivot point P2, the stirrup pivot point P4, and the mainspring connection point P5. The stirrup triangle T1 thus defines three (3) internal angles referred to herein as the hammer angle Θ1, the stirrup angle Θ2, and the spring angle Θ3.

As best shown in FIG. 4A, when the lock mechanism 114 is in the resting state, the largest of the angles Θ1, Θ2, and Θ3 is the hammer angle Θ1. That is, the hammer angle Θ1 has a greater magnitude than either of the stirrup angle Θ2 and the spring angle Θ3 when the lock mechanism 114 is in the resting state.

Shifting of the lock mechanism 114 from the resting state to the initial contact state to the contact shifting state and thereafter to the imminent release state results in a "flattening" of the stirrup triangle T1 as manifested by, among other things, a gradual increase in the magnitude of the hammer angle Θ1 (and associated concurrent decrease of the magnitudes of the stirrup angle Θ2 and the spring angle Θ3).

Alternatively stated, squeezing of the trigger 116 to shift the lock mechanism 114 from a resting state to the imminent firing state results in the stirrup triangle T1 becoming increasingly obtuse or, more specifically, the hammer angle Θ1 becoming increasingly obtuse.

Stated in yet another way, the hammer angle Θ1 has a first contact magnitude that is equal to a resting magnitude thereof; a contact shifting magnitude that is greater than the first contact magnitude; and an imminent release magnitude that is greater than the contact shifting magnitude.

As will be apparent from FIG. 8A, the hammer angle Θ1 has a firing state magnitude that is less than the imminent release magnitude. That is, hammer fall results in the stirrup triangle T1 shifting back toward a more acute form (although the triangle T1 nevertheless remains obtuse).

Preferably, the resting magnitude is between about one hundred ten degrees (110° and about one hundred thirty degrees (130°). Most preferably, the resting magnitude is about one hundred eighteen degrees (118°). The first contact magnitude is likewise preferably between about one hundred ten degrees (110°) and about one hundred thirty degrees (130°). Most preferably, the first contact magnitude is about one hundred eighteen degrees (118°). The contact shifting magnitude is preferably between about one hundred thirty degrees (130°) and about one hundred fifty degrees (150°). Most preferably, the contact shifting magnitude is about one hundred forty-one degrees (141°). The imminent release magnitude is preferably between about one hundred forty degrees (140°) and about one hundred sixty degrees (160°). Most preferably, the imminent release magnitude is about one hundred forty-nine degrees (149°.

Thus, the magnitude of the hammer angle Θ1 preferably increases from the resting state of the lock mechanism 114 to the imminent firing state of the lock mechanism 114 by between about twenty degrees (20°) and about forty degrees (40°), more preferably by between about twenty-five degrees (25°) and about thirty-five degrees (35°), and most preferably by about thirty-one degrees (31°).

It is particularly noted that the hammer pivot point P2 is offset relative to and spaced in the fore-and-aft direction between the stirrup pivot point P4 and the mainspring connection point P5. Even more specifically, the hammer pivot point P2 is disposed forward of the mainspring connection point P5 and aftward or rearward of the stirrup pivot point P4. Thus, the hammer pivot point P2 is the intermediate one of the points P2, P4, and P5, relative to the fore-aft direction, and acts as the vertex of the hammer angle Θ1.

In keeping with the above, the hammer angle Θ1 might therefore alternatively be referred to as an intermediate angle Θ1. Thus, it may be stated that the intermediate angle Θ1 increases in magnitude as the lock mechanism 114 shifts from the resting state to the imminent firing state.

It is also noted that the stirrup pivot point P4 is preferably disposed below both the mainspring connection point P5 and the hammer pivot point P2.

In contrast, the mainspring connection point P5 and the hammer pivot point P2 are preferably largely equally disposed vertically, albeit with small offsets as illustrated in the figures, during the course of shifting of the lock mechanism 114 through the various states described above.

It is particularly noted that such relative positioning of the points P2, P4, and P5 (and, in turn, of the angles associated therewith) is maintained throughout the entire range of motion of the lock mechanism 114.

This geometry varies significantly from that of the prior art firearm 10. For instance, with reference to FIG. 1A, it is clear that when the lock mechanism 14 is in a resting state or the illustrated initial contact state, the largest of the angles α1, α2, and α3 is not the hammer angle α1, but instead the stirrup angle α2.

Furthermore, shifting of the lock mechanism 14 from the resting state to the initial contact state (see FIG. 1A) to the contact shifting state and thereafter to the imminent release state (see FIG. 2A) results in a "narrowing" of the stirrup triangle t1 (i.e., with reference to its largest initial angle) as manifested by, among other things, a gradual decrease in the magnitude of the stirrup angle α2.

Alternatively stated, squeezing of the trigger 16 to shift the lock mechanism 14 from a resting state to the imminent firing state results in the stirrup angle α1 becoming increasingly acute (from an initial at least substantially right-angled configuration). The hammer angle α1 undergoes only minor changes during the course of such shifting.

Still further, in contrast to the previously described intermediate lateral positioning of the hammer pivot point P2 of the inventive firearm 110, the hammer pivot point p2 of the prior art lock mechanism 14 is disposed forward of both the stirrup pivot point p4 and the spring connection point p5. Alternatively stated, the stirrup pivot point p4 of the prior art firearm 10 is offset from and spaced laterally between the hammer pivot point p2 and the spring connection point p5. More particularly, the stirrup pivot point p4 is disposed rearward of the hammer pivot point p2 and forward of the spring connection point p5. As best shown in FIGS. 1A and 2A, such relative positioning of the points p2, p4, and p5 is maintained through the entire range of motion of lock mechanism 14.

In keeping with the above, the stirrup angle α2 might therefore alternatively be referred to as an intermediate angle α2. Thus, it may be stated that the intermediate angle α2 decreases in magnitude as the lock mechanism 14 shifts from the resting state to the imminent firing state (i.e., in contrast to the intermediate angle Θ1 of the lock mechanism 114, which increases in magnitude during corresponding shifting of the lock mechanism 114).

Toggle Linkage

A best shown in FIG. 5A, a hypothetical sear triangle T2 is defined by the hammer pivot point P2, the trigger pivot point P1, and the first hammer assembly contact point CP2 (i.e., the contact point between the trigger 116 and the sear 122) when the lock mechanism 114 is in the initial contact state.

The hammer pivot point P2, the trigger pivot point P1, and the first hammer assembly contact point CP2 preferably cooperatively define a trigger-to-sear angle Θ4 having the first hammer assembly contact point CP2 as a vertex thereof.

A straight hypothetical toggle line TL extends between and interconnects the hammer pivot point P2 and the trigger pivot point P1.

When the lock mechanism 114 is in the initial contact state, the first hammer assembly contact point CP2 is disposed on a first side of (i.e., below) the toggle line TL (see FIG. 5A). As the trigger 116 and the hammer 120 progressively pivot, in keeping with shifting of the lock mechanism 114 as described in detail above, the first hammer assembly contact point CP2 moves toward the toggle line TL, and the trigger-to-sear angle Θ4 increases in magnitude. That is, the sear triangle T2 "flattens".

Still further pivoting of the trigger 116 and the hammer 120 causes the first hammer assembly contact point CP2 to cross over the toggle line TL. As best shown in FIG. 6A, for instance, the first hammer assembly contact point CP2 is disposed on a second side of (i.e., above) the toggle line TL when the lock mechanism 114 is in the contact shifting state. That is, the sear triangle T2 "flips," with the magnitude of the trigger-to-sear angle Θ4 progressively decreasing after the first hammer assembly contact point CP2 crosses over the toggle line TL (i.e., the sear triangle T2 "narrows").

It is particularly noted that, in a functional sense, the toggle line TL defines a boundary or margin past which movement of the first hammer assembly contact point CP2 results in a "holding back" of the hammer 120 due to the above-described shaping of the cam surface 160. That is, should trigger pull cease just after the first hammer assembly contact point CP2 crosses over the toggle line TL, the trigger 116 will hold the hammer 120 in place without further intervention. Alternatively stated, a toggle linkage is formed. Furthermore, the force required to pull the trigger 116 further is, at this stage, at least substantially equal to that necessary to instead actuate the trigger in a single-action mode.

As best shown in FIG. 6A, a hypothetical trigger triangle T3 is defined by the hammer pivot point P2, the trigger pivot point P1, and the second hammer assembly contact point CP3 (i.e., the contact point between the trigger 116 and the hammer body 146) when the lock mechanism 114 is in the contact shifting state.

The hammer pivot point P2, the trigger pivot point P1, and the second hammer assembly contact point CP3 preferably cooperatively define a trigger-to-hammer angle Θ5 having the second hammer assembly contact point CP3 as a vertex thereof.

When the lock mechanism 114 is in the contact shifting state, as shown in FIGS. 6 and 6A, the second hammer assembly contact point CP3 is disposed on a first side of (i.e., below) the toggle line TL. As the trigger 116 and the hammer 120 progressively pivot, in keeping with shifting of the lock mechanism 114 as described in detail above, the second hammer assembly contact point CP3 moves toward the toggle line TL, and the trigger-to-hammer angle Θ5 increases in magnitude. That is, the trigger triangle T3 "flattens".

Still further pivoting of the trigger 116 and the hammer 120 causes the second hammer assembly contact point CP3 to cross over the toggle line TL. As best shown in FIG. 7A, for instance, the second hammer assembly contact point CP3 is disposed on a second side of (i.e., above) the toggle line TL when the lock mechanism 114 is in the imminent release state. That is, the trigger triangle T3 "flips," with the magnitude of the trigger-to-hammer angle Θ5 progressively decreasing after the second hammer assembly contact point CP3 crosses over the toggle line TL (i.e., the trigger triangle T3 "narrows").

This is in contrast to the prior art firearm 10, in which the second hammer assembly contact point cp3 is disposed just above or on the toggle line t1 when the lock mechanism 14 is in the contact shifting state and shifts so as to be disposed even further above the toggle line t1 when the lock mechanism 14 is in the imminent release state. That is, the second hammer assembly contact point cp3 is never disposed below the toggle line t1 and thus never crosses over the toggle line t1.

It is particularly noted that, when the lock mechanism 114 is in the imminent release state, the mainspring 124 is providing its greatest resistance. However, the above-described geometry, including the close proximity of both the stirrup pivot point P4 and the second hammer assembly contact point CP3 to the toggle line TL, provides a substantial mechanical advantage facilitating ease of continued pivoting of the trigger 116. That is, the trigger 116 has a mechanical advantage on the mainspring 124 due to the compound leverage of the stirrup 126 on the hammer 120.

In greater detail, and with reference to FIG. 7A, the trigger-to-hammer angle Θ5 might alternatively be understood as a contact point proximity angle Θ5. More particularly an increasing contact point proximity angle Θ5 corresponds to greater proximity of the second hammer assembly contact point CP3 to the toggle line TL.

Similarly, and as also shown in FIG. 7A, a stirrup pivot proximity angle Θ6 is cooperatively defined by the hammer pivot point P2, the stirrup pivot point P4, and the trigger pivot point P1, with the stirrup pivot point P4 being the vertex of the stirrup pivot proximity angle Θ6. As will be apparent to those of ordinary skill in the art, an increasing stirrup pivot proximity angle Θ6 corresponds to greater proximity of the stirrup pivot point P4 to the toggle line TL.

A stirrup proximity triangle T4 is likewise cooperatively defined by the trigger pivot point P1, the hammer pivot point P2, and the stirrup pivot point P4. The toggle line TL thus forms one side of the stirrup proximity triangle T4.

When the lock mechanism 114 is in the imminent release state, the contact point proximity angle Θ5 is preferably greater than or equal to about one hundred thirty-five degrees (135°), more preferably greater than or equal to about one hundred fifty degrees (150°), and most preferably about one hundred sixty-two degrees (162°).

Similarly, when the lock mechanism 114 is in the imminent release state, the stirrup pivot proximity angle Θ6 is preferably greater than or equal to about one hundred thirty-five degrees (135°), more preferably greater than or equal to about one hundred fifty degrees (150°), and most preferably about one hundred sixty-seven degrees (167°).

With regard to nominal dimensions, when the lock mechanism 114 is in the imminent release state, the toggle line TL has a length of about one and two hundred fifty-seven thousandths (1.257) inches. The second hammer assembly contact point CP3 is offset orthogonally from the toggle line TL by about one hundred thousandths (0.100) inches. The stirrup pivot point P4 is offset orthogonally from the toggle line TL by about fifty-six thousandths (0.056) inches.

In a relative sense, the second hammer assembly contact point CP3 is thus offset orthogonally from the toggle line TL by an offset distance equal to about seven and ninety-six hundredths percent (7.96%) of the length of the toggle line TL. The stirrup pivot point P4 is offset orthogonally from the toggle line TL by an offset distance equal to about four and forty-six hundredths percent (4.46%) of the length of the toggle line TL.

In view of the above, it is preferred that each of the second hammer assembly contact point CP3 and the stirrup pivot point P4 be disposed within an orthogonal offset distance from the toggle line TL that is less than or equal to about fifteen percent (15%) of the length of the toggle line TL, more preferably less than or equal to about ten percent (10%) of the length of the toggle line TL, and most preferably about seven and ninety-six hundredths percent (7.96%) of the length of the toggle line TL.

This geometry also varies significantly from that of the prior art firearm 10. For instance, when the prior art lock mechanism 14 is in the imminent release state, as shown in FIGS. 2 and 2A, the second hammer assembly contact point p3 is in relatively close proximity to the toggle line t1, but the stirrup pivot point p4 is significantly offset from the toggle line t1.

That is, while the prior art contact point proximity angle α5 is relatively large (i.e., about one hundred sixty-six degrees [166°]), the prior art stirrup pivot proximity angle α6 is relatively small (i.e., about eighty-three degrees [83°]).

Furthermore, whereas the toggle line t1 of the example prior art firearm 10 also has a length of about one and two hundred fifty-seven thousandths (1.257) inches when the lock mechanism 14 is in the imminent release state, the hammer assembly contact point cp3 is disposed an orthogonal offset distance of about eighty thousandths (0.080) inches therefrom, and the stirrup pivot point p4 is spaced therefrom by an orthogonal offset distance of about two hundred eighty thousandths (0.280) inches. In a relative sense, the hammer assembly contact point cp3 is thus offset from the prior art toggle line t1 by a relatively small orthogonal offset distance equal to about six and thirty-three hundredths percent (6.33%) of the length of the toggle line t1. The stirrup pivot point p4, however, is offset from the prior art toggle line t1 by a relatively large orthogonal offset distance equal to about twenty-two and twenty-nine hundredths percent (22.29%) of the length of the toggle line t1. Thus, the prior art lock mechanism 14 fails to achieve the mechanical advantage provided by the previously described near-alignment of the toggle line TL, the second hammer assembly contact point CP3, and the stirrup pivot point P4 of the inventive lock mechanism 114.

Functional Impact of Geometrical Innovations

The above-described relative positioning of key components and connection points, along with certain of the geometric features defined thereby, facilitates highly advantageous trigger pull characteristics without the need for other changes to the lock mechanism in a broad sense.

For instance, as will be readily understood by those of ordinary skill in the art, a conventional firearm without the innovative lock mechanism 114 would, when using a double-action trigger pull, typically have a relatively constant or only slightly reducing pull weight throughout the range of motion of the trigger. For instance, in a double-action mode, a relatively heavy starting pull weight of about twelve (12) lb associated with an example prior art firearm might reduce by about thirty-three percent (33%) to a weight of about eight (8) lb at let-off (i.e., the imminent release state). A different example prior art firearm, again in a double-action mode, might feature a much lighter initial trigger pull weight of about seven and one half (7.5) lb but achieve a reduction of only about one and one half (1.5) lb, or about twenty percent (20%), resulting in a trigger pull weight at let-off of about six (6) lb.

It is noted that a variety of factors, including but not limited to primer selection and after-market modifications, might alter these example prior art numbers to at least some extent. For instance, use of a harder or softer primer will require or facilitate heavier or lighter starting pull weights, respectively. After-market modifications might successfully in some instances slightly reduce the pull weight at one or more stages but are typically associated with other less-desirable effects and may additionally be relatively expensive.

The present invention, however, enables significant reductions of the final trigger pull weight (i.e., at let-off) in double-action mode and additionally causes a reduction in the pull weight over the range of motion of the trigger, without detrimental side-effects.

More particularly, the previously described angles and toggle linkage enable an initial trigger pull weight, depending on the primer used, that is preferably less than about ten (10) lb, more preferably less than about eight (8) lb, and most preferably less than or equal to about six (6) lb.

With regard to gradual reduction in the trigger pull forces over the trigger range of motion (i.e., from the initial resting state to the imminent firing state), it is preferable that a reduction of pull force of at least forty-five percent (45%), more preferably at least fifty-five percent (55%), and most preferably at least about sixty-five (65%) is achieved.

Alternatively stated, the inventive lock mechanism 114 preferably reduces the trigger pull weight by at least about two (2) lb over the trigger range of motion, more preferably by at least about three (3) lb over the trigger range of motion, and most preferably by at least about four (4) lb over the trigger range of motion.

For instance, the firearm 110 most preferably presents an initial trigger pull weight of about six (6) lb, as noted above, which gradually reduces to an imminent release trigger pull weight of about two (2) lb. A force reduction of about four (4) lb, or about sixty-seven percent (67%), is thus achieved.

In an alternative firearm embodying the present invention, an initial trigger pull weight of about thirteen (13) lb is reduced by about sixty-one and five tenths percent (61.5%) over the trigger range of motion, to about five (5) lb at let-off. Thus, a force reduction of about eight (8) lb is achieved.

As will be readily understood by those of ordinary skill in the art, the present invention presents numerous practical advantages both for casual and competitive shooters.

For instance, the reduction in trigger pull weight in a broad sense reduces the necessary hand strength to fire the firearm 110 and, in circumstances requiring repetitive firing, reduces gradual fatigue. Reduced pull weight also may have positive effects on shooting accuracy due to the decreased forces provided by the shooter.

The gradual decrease in pull weight afforded by the lock mechanism 114 is also advantageous in terms of accuracy, as the final trigger movements effected by the shooter prior to firing require very little force and are thus more easily controlled by the shooter.

The pull force effects described herein are achieved without decreases in the hammer impact force (as transferred to the primer) as well, reducing misfire risks that would be associated with a lighter pull weight resulting from a skeletonized hammer, lightened mainspring, and/or other modifications affecting hammer impact force.

Additional Features and Advantages

It is particularly noted that the inventive lock mechanism 114 can be conveniently provided both as part of an original, as-manufactured firearm or in modular form for retrofitting purposes. That is, an existing prior art firearm (e.g., a revolver, semi-automatic handgun, rifle, or shotgun) might be readily upgraded via the installation of the inventive lock mechanism 114 or selected component(s) thereof. For instance, the lock mechanism 114 is well suited for use in K-, L-, N-, and X-frame revolvers manufactured by Smith & Wesson®.

A variety of other advantageous features may also be provided. Integrated frame size markings (not shown) might be stamped, etched, printed, or otherwise applied to one or more components of the lock mechanism, for instance. Such indicia most preferably would be provided in a durable and easily visible manner (e.g., as an easily read recessed marking on the hammer).

A set screw (not shown) might extend through the grip portion of the frame to engage the mainspring near a lower end thereof, providing a convenient means for modification of the mainspring properties.

Still further, one or more holes or apertures might be provided in the hammer for tooling. One or more apertures or holes defined by the hammer (for instance, the uppermost one of the illustrated apertures defined by the hammer 120) might additionally or alternatively be configured for use with a gauge or other device for determining relevant forces and/or ranges of motion (e.g., pull weight, hammer impact force, hammer range of motion, etc.).

CONCLUSION

Features of one or more embodiments described above may be used in various combinations with each other and/or may be used independently of one another. For instance, although a single disclosed embodiment may include a preferred combination of features, it is within the scope of certain aspects of the present invention for the embodiment to include only one (1) or less than all of the disclosed features, unless the specification expressly states otherwise or as might be understood by one of ordinary skill in the art. Therefore, embodiments of the present invention are not necessarily limited to the combination(s) of features described above.

The preferred forms of the invention described above are to be used as illustration only and should not be utilized in a limiting sense in interpreting the scope of the present invention. Obvious modifications to the exemplary embodiments, as hereinabove set forth, could be readily made by those skilled in the art without departing from the spirit of the present invention.

Although the above description presents features of preferred embodiments of the present invention, other preferred embodiments may also be created in keeping with the principles of the invention. Furthermore, as noted previously, these other preferred embodiments may in some instances be realized through a combination of features compatible for use together despite having been presented independently as part of separate embodiments in the above description.

The inventor hereby states his intent to rely on the Doctrine of Equivalents to determine and access the reasonably fair scope of the present invention as pertains to any apparatus not materially departing from but outside the literal scope of the invention set forth in the following claims.

What is claimed is:

1. A lock mechanism for a firearm, said firearm configured to launch a projectile in a lateral direction, said lock mechanism comprising:

a trigger pivotable about a trigger pivot point;

a hammer pivotable about a hammer pivot point;

a stirrup connected to the hammer at a stirrup connection point; and a spring operably connected to the stirrup at a spring connection point, progressive pivoting of the trigger about the trigger pivot point, from a preparatory trigger position to an imminent release trigger position, driving corresponding progressive pivoting of the hammer about the hammer pivot point, from a preparatory hammer position to an imminent release hammer position, said spring yieldably resisting pivoting of the hammer from the preparatory hammer position to the imminent release hammer position, one of said spring connection point, said hammer pivot point, and said stirrup connection point being offset relative to and laterally spaced between the others of said points so as to be a vertex of an intermediate angle cooperatively defined by said points, said intermediate angle increasing in magnitude as the hammer pivots from the preparatory hammer position to the imminent release hammer position.

2. The lock mechanism of claim 1, said spring applying a spring force at the spring connection point, said spring connection point being spaced from the stirrup connection point such that the spring force generates a moment about the stirrup connection point.

3. The lock mechanism of claim 1, said spring applying a spring force at the spring connection point, said spring connection point being spaced from the hammer such that the spring force is offset from the hammer.

4. The lock mechanism of claim 1, said spring angling relative to the stirrup at the spring connection point.

5. The lock mechanism of claim 4, said spring extending generally orthogonally relative to at least a portion of the stirrup.

6. The lock mechanism of claim 1, said stirrup including a hammer portion pivotably connected to the hammer at the stirrup connection point and a spring portion operably connected to the spring at the spring connection point, said hammer portion and said spring portion engaging one another to form an elbow.

7. The lock mechanism of claim 6, wherein the lateral direction is a forward direction, said hammer portion extending generally in the forward direction when the hammer is in the preparatory hammer position, said spring portion extending from a rear edge of the hammer portion.

8. The lock mechanism of claim 1, wherein the lateral direction is a forward direction, said stirrup extending rearward and upward from the hammer.

9. The lock mechanism of claim 1, said intermediate angle having a preparatory magnitude between about 110 degrees and 130 degrees when the trigger is in the preparatory trigger position and the hammer is in the preparatory hammer position.

10. The lock mechanism of claim 9, said intermediate angle having an imminent release magnitude between about 140 degrees and 160 degrees when the trigger is in the imminent release trigger position and the hammer is in the imminent release hammer position.

11. The lock mechanism of claim 1, said intermediate angle increasing in magnitude by between about 20 degrees and about 40 degrees as the hammer pivots from the preparatory hammer position to the imminent release hammer position.

12. The lock mechanism of claim 1, said trigger contacting the hammer at a contact point when the trigger is in the imminent release trigger position and the hammer is in the imminent release hammer position, said contact point being vertex of a contact point proximity angle cooperatively defined by the hammer pivot point, the contact point, and the trigger pivot point, said stirrup connection point being vertex of a stirrup connection proximity angle cooperatively defined by the hammer pivot point, the stirrup connection point, and the trigger pivot point, said contact point proximity angle and said stirrup connection proximity angle each being greater than or equal to about 135°.

13. The lock mechanism of claim 1, said progressive pivoting of the trigger, from the preparatory trigger position to the imminent release trigger position, being achievable upon application to the trigger of a gradually decreasing applied force equal to a gradually decreasing trigger pull force.

14. The lock mechanism of claim 13, said gradually decreasing trigger pull force gradually decreasing by at least about 45% as the trigger progressively pivots from the preparatory trigger position to the imminent release trigger position.

15. The lock mechanism of claim 1, said spring connection point, said stirrup connection point, and said trigger pivot point being at least substantially aligned when the hammer is in the imminent release position.

16. A lock mechanism for a firearm, said firearm configured to launch a projectile in a lateral direction, said lock mechanism comprising:

a trigger pivotable about a trigger pivot point;

a hammer pivotable about a hammer pivot point;

a stirrup connected to the hammer at a stirrup connection point; and a spring operably connected to the stirrup at a spring connection point, progressive pivoting of the trigger about the trigger pivot point, from a preparatory trigger position to an imminent release trigger position, driving corresponding progressive pivoting of the hammer about the hammer pivot point, from a preparatory hammer position to an imminent release hammer position, said spring yieldably resisting pivoting of the hammer from the preparatory hammer position to the imminent release hammer position, said hammer pivot point being laterally spaced between the spring connection point and the stirrup connection point so as to be a vertex of an intermediate angle cooperatively defined by said points, said intermediate angle increasing in magnitude as the hammer pivots from the preparatory hammer position to the imminent release hammer position.

17. The lock mechanism of claim 16, said intermediate angle increasing in magnitude by between about 20 degrees and about 40 degrees as the hammer pivots from the preparatory hammer position to the imminent release hammer position.

18. The lock mechanism of claim 16, said trigger contacting the hammer at a contact point when the trigger is in the imminent release trigger position and the hammer is in the imminent release hammer position, said contact point being vertex of a contact point proximity angle cooperatively defined by the hammer pivot point, the contact point, and the trigger pivot point, said stirrup connection point being vertex of a stirrup connection proximity angle cooperatively defined by the hammer pivot point, the stirrup connection point, and the trigger pivot point, said contact point proximity angle and said stirrup connection proximity angle each being greater than or equal to about 135°.

19. The lock mechanism of claim 16, said spring applying a spring force at the spring connection point, said spring connection point being spaced from the stirrup connection point such that the spring force generates a moment about the stirrup connection point.

20. The lock mechanism of claim 16, said spring angling relative to the stirrup at the spring connection point.

* * * * *